US007329127B2

(12) United States Patent
Kendir et al.

(10) Patent No.: US 7,329,127 B2
(45) Date of Patent: Feb. 12, 2008

(54) FIREARM LASER TRAINING SYSTEM AND METHOD FACILITATING FIREARM TRAINING FOR EXTENDED RANGE TARGETS WITH FEEDBACK OF FIREARM CONTROL

(75) Inventors: Tansel Kendir, Eldersburg, MD (US); Motti Shechter, Potomac, MD (US); John Clark, Finksburg, MD (US)

(73) Assignee: L-3 Communications Corporation, New York, NY (US)

( * ) Notice: Subject to any disclaimer, the term of this patent is extended or adjusted under 35 U.S.C. 154(b) by 843 days.

(21) Appl. No.: 10/167,750

(22) Filed: Jun. 10, 2002

(65) Prior Publication Data

US 2002/0197584 A1 Dec. 26, 2002

Related U.S. Application Data

(60) Provisional application No. 60/341,148, filed on Dec. 17, 2001, provisional application No. 60/297,209, filed on Jun. 8, 2001.

(51) Int. Cl.
*F41G 3/26* (2006.01)

(52) U.S. Cl. ..... 434/21; 434/16; 434/19

(58) Field of Classification Search ..... 434/11–27
See application file for complete search history.

(56) References Cited

U.S. PATENT DOCUMENTS

| | | | |
|---|---|---|---|
| 2,023,497 | A | 12/1935 | Trammell |
| 2,934,634 | A | 4/1960 | Hellberg |
| 3,452,453 | A | 7/1969 | Ohlund |
| 3,510,965 | A | 5/1970 | Rhea |
| 3,526,972 | A | 9/1970 | Sumpf |
| 3,590,225 | A | 6/1971 | Murphy |
| 3,633,285 | A | 1/1972 | Sensney |
| 3,782,832 | A | 1/1974 | Hacskaylo |
| 3,792,535 | A | 2/1974 | Marshall et al. |
| 3,888,022 | A | 6/1975 | Pardes et al. |
| 3,938,262 | A | 2/1976 | Dye et al. |

(Continued)

FOREIGN PATENT DOCUMENTS

| | | |
|---|---|---|
| DE | 30 45 509 | 7/1982 |

(Continued)

OTHER PUBLICATIONS

Merlin. "Target Shilloutte". Feb. 23, 1999. Retreived from the internet <HTTP://members.tripod.com/~Merlin_30/T7.html>.*

*Primary Examiner*—Xuan M. Thai
*Assistant Examiner*—Robert J Utama
(74) *Attorney, Agent, or Firm*—Edell, Shapiro & Finnan, LLC

(57) ABSTRACT

A firearm laser training system of the present invention includes a target assembly, a laser transmitter assembly that attaches to a firearm, a detection device and a processor in communication with the detection device. The system simulates targets at extended ranges and accounts for various environmental and other conditions. The target may be in the form of a target image or a display screen. The detection device captures images of the target for processing by the processor to determine beam impact locations. The processor applies various offsets to the beam impact locations to account for the various conditions and determine the impact locations relative to the target. The processor displays an image of the target including the determined impact locations and scoring and/or other information that is based on those impact locations. An electronic laser filter may be employed by the system to minimize false impact detections.

82 Claims, 14 Drawing Sheets

U.S. PATENT DOCUMENTS 3,995,376 A 12/1976 Kimble et al.
3,996,674 A 12/1976 Pardes et al.
4,048,489 A 9/1977 Giannetti
4,068,393 A 1/1978 Tararine et al.
4,102,059 A 7/1978 Kimble et al.
4,164,081 A 8/1979 Berke
4,177,580 A 12/1979 Marshall et al.
4,195,422 A 4/1980 Budmiger
4,218,834 A 8/1980 Robertsson
4,222,564 A 9/1980 Allen et al.
4,256,013 A 3/1981 Quitadama
4,269,415 A 5/1981 Thorne-Booth
4,281,993 A 8/1981 Shaw
4,290,757 A 9/1981 Marshall et al.
4,313,272 A 2/1982 Matthews
4,313,273 A 2/1982 Matthews et al.
4,336,018 A 6/1982 Marshall et al.
4,340,370 A 7/1982 Marshall et al.
4,352,665 A 10/1982 Kimble et al.
4,367,516 A 1/1983 Jacob
4,439,156 A * 3/1984 Marshall et al. ..... 434/12
4,452,458 A 6/1984 Timander et al.
4,553,943 A 11/1985 Ahola et al.
4,561,849 A 12/1985 Eichweber
4,572,509 A 2/1986 Sitrick
4,583,950 A 4/1986 Schroeder
4,592,554 A 6/1986 Gilbertson
4,619,615 A 10/1986 Kratzenberg
4,619,616 A 10/1986 Clarke
4,640,514 A 2/1987 Myllyla et al.
4,657,511 A 4/1987 Allard et al.
4,662,845 A 5/1987 Gallagher et al.
4,678,437 A 7/1987 Scott et al.
4,680,012 A 7/1987 Morley et al.
4,695,256 A 9/1987 Eichweber
4,737,106 A 4/1988 Laciny
4,761,907 A 8/1988 De Bernardini
4,786,058 A 11/1988 Baughman
4,788,441 A 11/1988 Laskowski
4,789,339 A 12/1988 Bagnall-Wild et al.
4,804,325 A 2/1989 Willits et al.
4,811,955 A 3/1989 De Bernardini
4,830,617 A 5/1989 Hancox et al.
4,864,515 A 9/1989 Deck
4,898,391 A 2/1990 Kelly et al.
4,922,401 A 5/1990 Lipman
4,923,402 A 5/1990 Marshall et al.
4,934,937 A 6/1990 Judd
4,947,859 A 8/1990 Brewer et al.
4,948,371 A 8/1990 Hall
4,955,812 A * 9/1990 Hill ..... 434/16
4,983,123 A 1/1991 Scott et al.
4,988,111 A 1/1991 Gerlizt et al.
5,004,423 A 4/1991 Bertrams
5,026,158 A * 6/1991 Golubic ..... 356/252
5,035,622 A 7/1991 Marshall et al.
5,064,988 A 11/1991 E'nama et al.
5,090,708 A 2/1992 Gerlitz et al.
5,092,071 A 3/1992 Moore
5,095,433 A 3/1992 Botarelli et al.
5,119,576 A 6/1992 Erning
5,140,893 A 8/1992 Leiter
5,153,375 A 10/1992 Eguizabal
5,179,235 A 1/1993 Toole
5,181,015 A 1/1993 Marshall et al.
5,194,006 A * 3/1993 Zaenglein, Jr. ..... 434/19
5,194,007 A 3/1993 Marshall et al.
5,194,008 A * 3/1993 Mohan et al. ..... 434/22
5,208,418 A * 5/1993 Toth et al. ..... 89/41.07
5,213,503 A 5/1993 Marshall et al.
5,215,465 A 6/1993 Marshall et al.
5,237,773 A 8/1993 Claridge
5,281,142 A 1/1994 Zaenglein, Jr.
5,328,190 A 7/1994 Dart et al.
5,344,320 A 9/1994 Inbar et al.
5,365,669 A 11/1994 Rustick et al.
5,366,229 A 11/1994 Suzuki
5,400,095 A 3/1995 Minich et al.
5,413,357 A 5/1995 Schulze et al.
5,433,134 A 7/1995 Leiter
5,474,452 A 12/1995 Campagnuolo
5,486,001 A 1/1996 Baker
5,488,795 A 2/1996 Sweat
5,489,923 A 2/1996 Marshall et al.
5,502,459 A 3/1996 Marshall et al.
5,504,501 A 4/1996 Hauck et al.
5,515,079 A 5/1996 Hauck
5,529,310 A 6/1996 Hazard et al.
5,551,876 A 9/1996 Koresawa et al.
5,577,733 A * 11/1996 Downing ..... 273/348
5,585,589 A 12/1996 Leiter
5,591,032 A 1/1997 Powell et al.
5,594,468 A 1/1997 Marshall et al.
5,605,461 A 2/1997 Seeton
5,613,913 A 3/1997 Ikematsu et al.
5,641,288 A 6/1997 Zaenglein, Jr.
5,672,108 A 9/1997 Lam et al.
5,685,636 A 11/1997 German
5,716,216 A 2/1998 O'Loughlin et al.
5,738,522 A 4/1998 Sussholz et al.
5,740,626 A 4/1998 Schuetz et al.
5,788,500 A 8/1998 Gerber
5,842,300 A 12/1998 Cheshelski et al.
5,890,906 A 4/1999 Macri et al.
5,933,132 A 8/1999 Marshall et al.
5,947,738 A 9/1999 Muehle et al.
5,999,210 A 12/1999 Nemiroff et al.
6,012,980 A 1/2000 Yoshida et al.
6,028,593 A 2/2000 Rosenberg et al.
6,106,297 A * 8/2000 Pollak et al. ..... 434/16
6,252,706 B1 * 6/2001 Kaladgew ..... 359/399
6,296,486 B1 10/2001 Cardaillac et al.
6,315,568 B1 11/2001 Hull et al.
6,322,365 B1 * 11/2001 Shechter et al. ..... 434/21
6,551,189 B1 * 4/2003 Chen et al. ..... 463/49
6,572,375 B2 6/2003 Shechter et al.
6,575,753 B2 6/2003 Rosa et al.
6,579,098 B2 6/2003 Shechter
6,604,064 B1 * 8/2003 Wolff et al. ..... 703/7
6,616,452 B2 9/2003 Clark et al.
6,709,272 B2 * 3/2004 Siddle ..... 434/21
6,739,873 B1 * 5/2004 Rod et al. ..... 434/19
2002/0009694 A1 1/2002 Rosa
2002/0012898 A1 1/2002 Shechter et al.
2003/0136900 A1 7/2003 Shechter et al.
2003/0199324 A1 10/2003 Wang

FOREIGN PATENT DOCUMENTS

DE 3537323 4/1987
DE 3631081 A1 3/1988
DE 39 25 640 A1 2/1991
DE 4005940 A1 8/1991
DE 4029877 A1 3/1992
DE 42 07 933 A1 9/1993
DE 42 33 945 A1 4/1994
DE 195 19 503 A1 12/1995
EP 0 072 004 A2 2/1983
EP 0 285-586 A2 10/1988
EP 0 401 731 6/1990
EP 0467090 A1 1/1992
EP 0806621 11/1997
FR 2 726 639 A1 5/1996
GB 2141810 A 1/1985

| | | | | |
|---|---|---|---|---|
| GB | 2254403 | | | 10/1992 |
| GB | 2260188 | A | * | 4/1993 |
| GB | 2284 253 | A | | 5/1995 |
| JP | 49-103499 | | | 9/1974 |
| JP | 50-22497 | | | 3/1975 |
| JP | 54-40000 | | | 3/1979 |
| JP | 56-500666 | | | 5/1981 |
| JP | 59-191100 | | | 12/1984 |
| JP | 63-502211 | | | 8/1988 |
| JP | 2-101398 | A | | 4/1990 |
| JP | 5-223500 | | | 8/1993 |
| JP | 8-299605 | | | 11/1996 |
| RU | 1817825 | A3 | | 5/1993 |
| RU | 2 089 832 | C1 | | 9/1997 |
| WO | WO 91/09266 | | | 6/1991 |
| WO | WO 92/08093 | | | 5/1992 |
| WO | WO 94/03770 | | | 2/1994 |
| WO | WO 94/15165 | | | 7/1994 |
| WO | WO 96/15420 | | | 5/1996 |
| WO | WO 98/49514 | | | 11/1998 |
| WO | WO 99/10700 | | | 3/1999 |

* cited by examiner

FIREARM LASER TRAINING SYSTEM AND METHOD FACILITATING FIREARM TRAINING FOR EXTENDED RANGE TARGETS WITH FEEDBACK OF FIREARM CONTROL

CROSS-REFERENCE TO RELATED APPLICATIONS

This application claims priority from provisional U.S. Patent Application Ser. No. 60/297,209, entitled "Firearm Laser Training System and Method Facilitating Firearm Training for Extended Range Targets" and filed Jun. 8, 2001; and No. 60/341,148, entitled "Firearm Laser Training System and Method Facilitating Firearm Training for Extended Range Targets with Feedback of Firearm Control" and filed Dec. 17, 2001. The disclosures of the above-mentioned provisional applications are incorporated herein by reference in their entireties.

BACKGROUND OF THE INVENTION

1. Technical Field

The present invention pertains to firearm training systems, such as those disclosed in U.S. Pat. No. 6,322,365 (Shechter et al) and U.S. patent application Ser. No. 09/761,102, entitled "Firearm Simulation and Gaming System and Method for Operatively Interconnecting a Firearm Peripheral to a Computer System" and filed Jan. 16, 2001; Ser. No. 09/760,610, entitled "Laser Transmitter Assembly Configured For Placement Within a Firing Chamber and Method of Simulating Firearm Operation" and filed Jan. 16, 2001; Ser. No. 09/760,611, entitled "Firearm Laser Training System and Method Employing Modified Blank Cartridges for Simulating Operation of a Firearm" and filed Jan. 16, 2001; Ser. No. 09/761,170, entitled "Firearm Laser Training System and Kit Including a Target Structure Having Sections of Varying Reflectivity for Visually Indicating Simulated Projectile Impact Locations" and filed Jan. 16, 2001; Ser. No. 09/862,187, entitled "Firearm Laser Training System and Method Employing an Actuable Target Assembly" and filed May 21, 2001; and Ser. No. 09/878,786, entitled "Firearm Laser Training System and Method Facilitating Firearm Training With Various Targets and Visual Feedback of Simulated Projectile Impact Locations" and filed Jun. 11, 2001. The disclosures of the above-mentioned patent and patent applications are incorporated herein by reference in their entireties. In particular, the present invention pertains to a firearm laser training system that simulates conditions of extended range targets to facilitate firearm training for these types of targets.

2. Discussion of the Related Art

Firearms are utilized for a variety of purposes, such as hunting, sporting competition, law enforcement and military operations. The inherent danger associated with firearms necessitates training and practice in order to minimize the risk of injury. However, special facilities are required to facilitate practice of handling and shooting the firearm. These special facilities tend to provide a sufficiently sized area for firearm training, where the area required for training may become quite large, especially for sniper type or other firearm training with extended range targets. The facilities further confine projectiles propelled from the firearm within a prescribed space, thereby preventing harm to the surrounding environment. Accordingly, firearm trainees are required to travel to the special facilities in order to participate in a training session, while the training sessions themselves may become quite expensive since each session requires new ammunition for practicing handling and shooting of the firearm.

The related art has attempted to overcome the above-mentioned problems by utilizing laser or light energy with firearms to simulate firearm operation and indicate simulated projectile impact locations on targets. For example, U.S. Pat. No. 4,164,081 (Berke) discloses a marksman training system including a translucent diffuser target screen adapted for producing a bright spot on the rear surface of the target screen in response to receiving a laser light beam from a laser rifle on the target screen front surface. A television camera scans the rear side of the target screen and provides a composite signal representing the position of the light spot on the target screen rear surface. The composite signal is decomposed into X and Y Cartesian component signals and a video signal by a conventional television signal processor. The X and Y signals are processed and converted to a pair of proportional analog voltage signals. A target recorder reads out the pair of analog voltage signals as a point, the location of which is comparable to the location on the target screen that was hit by the laser beam.

U.S. Pat. No. 5,281,142 (Zaenglein, Jr.) discloses a shooting simulation training device including a target projector for projecting a target image in motion across a screen, a weapon having a light projector for projecting a spot of light on the screen, a television camera and a microprocessor. An internal device lens projects the spot onto a small internal device screen that is scanned by the camera. The microprocessor receives various information to determine the location of the spot of light with respect to the target image. In addition, when longer ranges are simulated, a lookup table can include information concerning the trajectory of a projectile fired by any simulated cartridge. This provides information to enable display of the amount the projectile falls, and, thereby, the amount the weapon muzzle should be held above the target at any given simulated distance as well as the amount of lead required for the moving target at such a distance.

U.S. Pat. No. 5,366,229 (Suzuki) discloses a shooting game machine including a projector for projecting a video image that includes a target onto a screen. A player may fire a laser gun to emit a light beam toward the target on the screen. A video camera photographs the screen and provides a picture signal to coordinate computing means for computing the X and Y coordinates of the beam point on the screen.

International Publication No. WO 92/08093 (Kunnecke et al.) discloses a small arms target practice monitoring system including a weapon, a target, a light-beam projector mounted on the weapon and sighted to point at the target and a processor. An evaluating unit is connected to the camera to determine the coordinates of the spot of light on the target. A processor is connected to the evaluating unit and receives the coordinate information. The processor further displays the spot on a target image on a display screen.

The systems described above suffer from several disadvantages. In particular, the Berke, Zaenglein, Jr. and Suzuki systems employ particular targets or target scenarios, thereby limiting the types of firearm training activities and simulated conditions provided by those systems. Further, the Berke system utilizes both front and rear target surfaces during operation. This restricts placement of the target to areas having sufficient space for exposure of those surfaces to a user and the system. The Berke and Kunnecke et al. systems merely display impact locations to a user, thereby requiring a user to interpret the display to assess user performance during an activity. The assessment is typically limited to the information provided on the display, thereby restricting feedback of valuable training information to the user and limiting the training potential of the system. In addition, the Berke, Suzuki and Kunnecke et al systems generally do not simulate training for extended range targets, thereby requiring trainees to travel to special facilities and/or utilize a large area to conduct such training as described above. The Zaenglein, Jr. system may simulate targets at longer ranges. However, this system does not account for actual environmental conditions (e.g., temperature, wind, weather, etc.) within the simulation that affect projectile trajectory. Thus, the realism of the simulation is limited, thereby substantially reducing the system training potential.

OBJECTS AND SUMMARY OF THE INVENTION

Accordingly, it is an object of the present invention to conduct firearm training with extended range targets in a confined area having dimensions substantially less than the extended range of the targets.

It is another object of the present invention to conduct firearm training with extended range targets via a firearm laser training system simulating actual environmental conditions and the projectile trajectory resulting from those conditions.

Yet another object of the present invention is to employ various targets scaled to varying ranges within a firearm laser training system to conduct desired training procedures for extended range targets.

Still another object of the present invention is to employ a target in the form of a display screen with a firearm laser training system to present various targets and/or scenarios during training.

A further object of the present invention is to assess user performance within a firearm laser training system by determining scoring and/or other performance information based on detected impact locations of simulated projectiles on a target.

Yet another object of the present invention is to employ an electronic laser filter within a firearm laser training system to minimize false detections of simulated projectile impact locations on a target.

The aforesaid objects may be achieved individually and/or in combination, and it is not intended that the present invention be construed as requiring two or more of the objects to be combined unless expressly required by the claims attached hereto.

According to the present invention, a firearm laser training system includes a target assembly, a laser transmitter assembly that attaches to a firearm, a detection device configured to scan the target and detect beam impact locations thereon, and a processor in communication with the detection device. The system simulates targets at extended ranges and accounts for various environmental and other conditions (e.g., wind, temperature, etc.) affecting projectile trajectory that may be encountered during actual firing. The training may be conducted within a confined area, typically having dimensions substantially less than the extended range of the targets. The target assembly may include a target in the form of a target image, or in the form of a display screen displaying a target, a target scenario and/or environmental conditions (e.g., wind, weather, etc.). The detection device captures images of the target for processing by the processor to determine beam impact locations. The processor applies various offsets to the beam impact locations to account for the various conditions and determine the impact locations relative to the target. The processor displays an image of the target including the determined impact locations and further evaluates user performance by providing scoring and/or other information that is based on those impact locations. An electronic laser filter may be employed by the system to minimize false detections of beam impact locations on the target. In addition, the system may be compact and portable to facilitate ease of use in a variety of different environments.

The above and still further objects, features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1A:
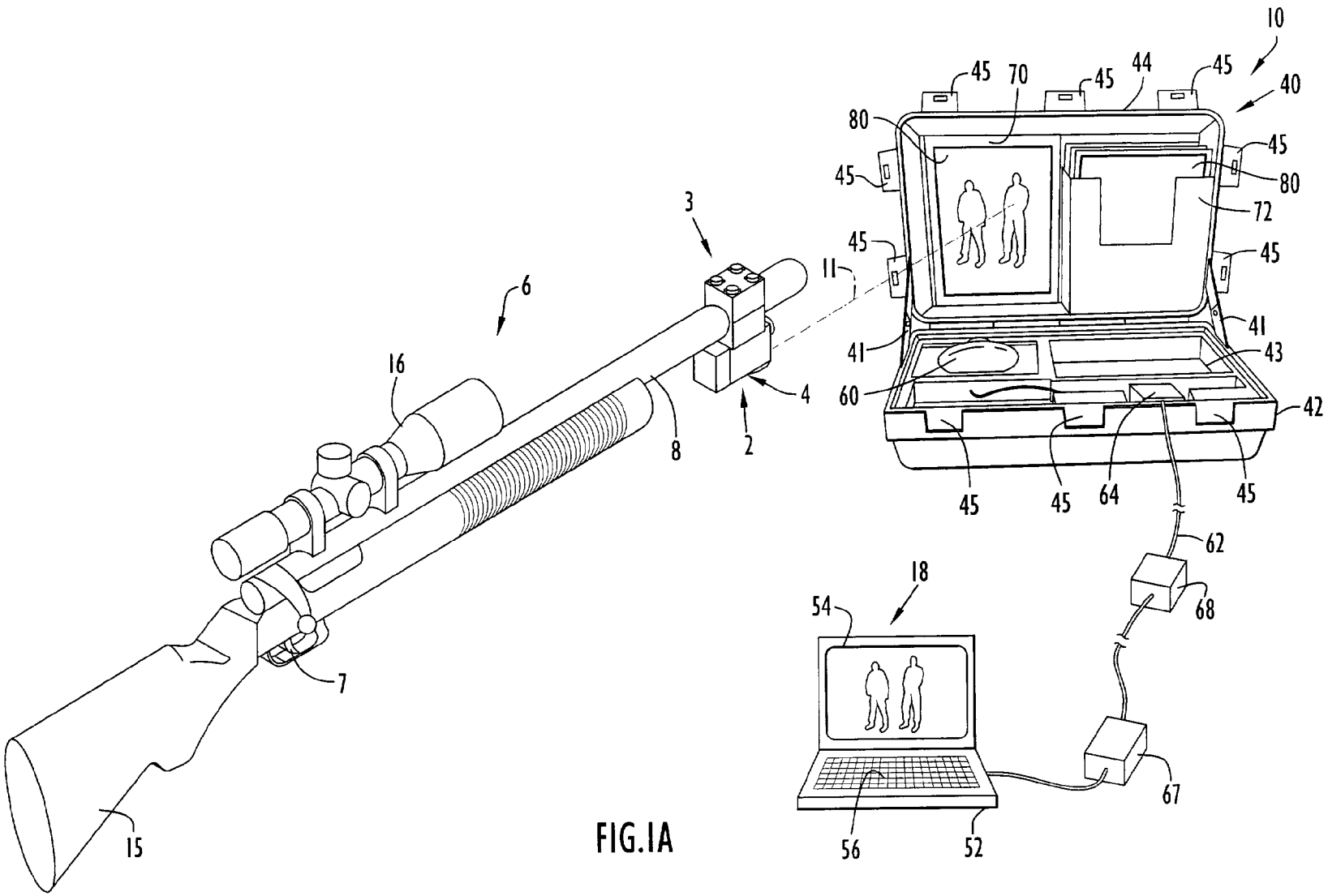
FIG. 1A is a view in perspective of a firearm laser training system having a laser beam directed from a firearm onto a target according to the present invention.

A firearm laser training system for extended range targets according to the present invention is illustrated in FIG. 1A. Specifically, the firearm laser training system includes a laser transmitter assembly 2, a firearm 6, a target assembly 10 and a computer system 18. The laser assembly is attached to unloaded user firearm 6 to adapt the firearm for compatibility with the training system. By way of example only, firearm 6 is preferably implemented by a rifle (e.g., an M24 Sniper Weapon System (SWS)) and includes a sniper-type trigger 7, a barrel 8, a stock 15 and a scope or sight 16. However, the firearm may be implemented by any type of conventional firearm (e.g., hand-gun, rifle, shotgun, etc.), while the laser may be implemented in the manner of any of the simulated firearms disclosed in the above-mentioned patent and patent applications. Laser assembly 2 includes a bracket or mount 3 and a laser transmitter module 4 that emits a beam 11 of visible laser light in response to actuation of trigger 7. Bracket 3 is connected to module 4 and is configured to fasten the laser assembly to firearm 6 as described below. A user adjusts scope 16 for simulated environmental or atmospheric conditions and aims unloaded firearm 6 at target assembly 10 for actuation of trigger 7 to project laser beam 11 from laser module 4 toward the target assembly. The target assembly detects the laser beam impact location and provides location information to computer system 18. The computer system processes the location information and displays simulated projectile impact locations on a scaled target via a graphical user screen (FIG. 8) as described below. In addition, the computer system may determine scoring and other information pertaining to the performance of a user. The training system may utilize "dry fire" type firearms or firearms utilizing modified blank cartridges (e.g., such as those disclosed in the above-mentioned patent and patent applications) for projecting a laser beam to provide full realism in a safe environment. It is to be understood that the terms "top", "bottom", "side", "front", "rear", "back", "lower", "upper", "height", "width", "thickness", "vertical", "horizontal" and the like are used herein merely to describe points of reference and do not limit the present invention to any specific orientation or configuration.

Computer system 18 is typically implemented by a conventional IBM-compatible or other type of personal computer (e.g., laptop, notebook, desk top, mini-tower, Apple MacIntosh, palm pilot, etc.) preferably equipped with a base 52 (e.g., including the processor, memories, and internal or external communication devices or modems), a display or monitor 54, a keyboard 56 and an optional mouse (not shown). The computer system preferably utilizes a Windows 95/98/NT/2000 platform, however, any of the major platforms (e.g., Linux, Macintosh, Unix or OS2) may be employed. Further, the system includes components (e.g., a processor, disk storage or hard drive, etc.) having sufficient processing and storage capabilities to effectively execute the software for the training system. The software is typically in the form of a Windows 95/98/NT/2000 application.

Figure 2:
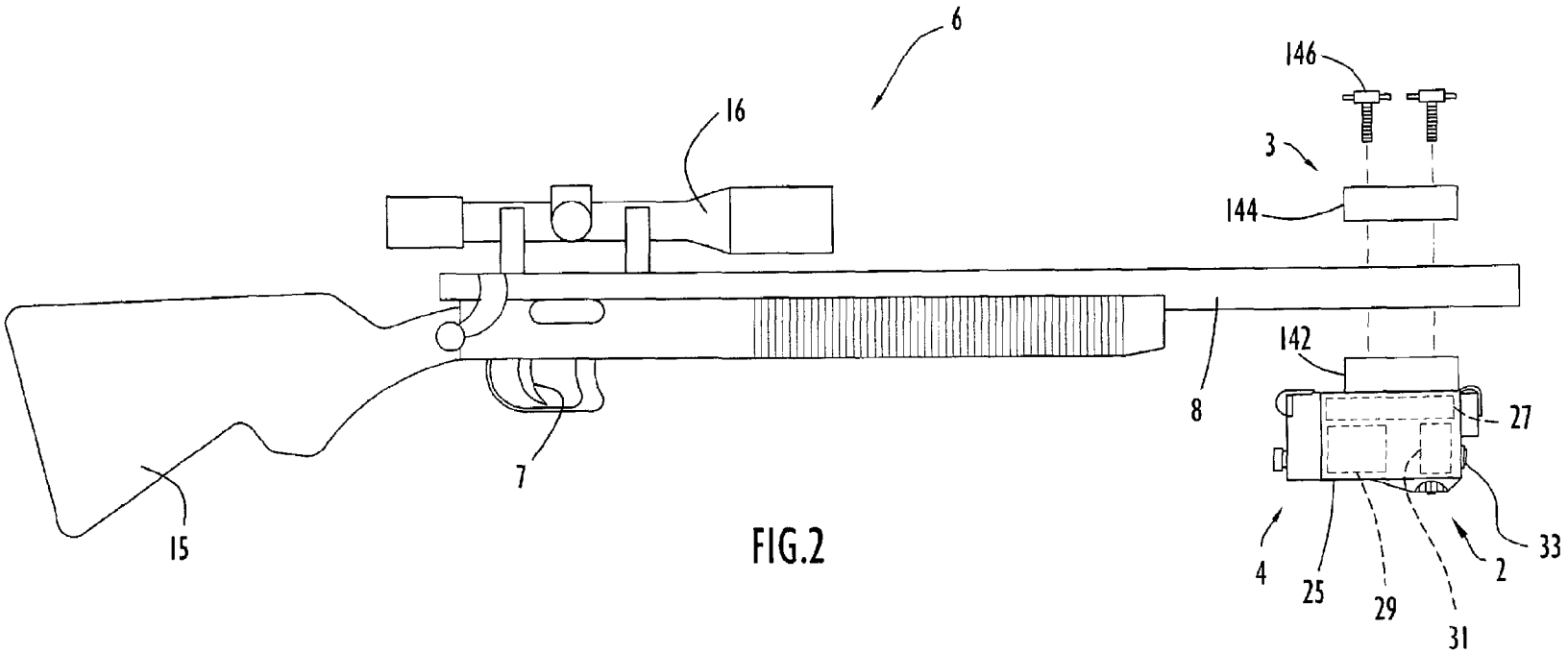
FIG. 2 is an exploded view in perspective of a laser transmitter assembly attached to the firearm of the system of FIG. 1A.

The laser transmitter assembly utilized in the present invention is typically similar to the laser transmitter assembly described in U.S. patent application Ser. No. 09/760,611. An exemplary laser transmitter assembly employed by the training system firearm is illustrated in FIG. 2. Specifically, laser assembly 2 includes bracket 3 and laser transmitter module 4. Bracket 3 may be implemented by any conventional or other bracket mount (e.g., a barrel band-type mount) to fasten the laser module to a distal portion of the firearm barrel. By way of example, bracket 3 includes substantially rectangular base and cover members 142, 144. The base and cover members each include a groove or recess (not shown) defined therein and configured to receive barrel 8. Base member 142 is connected to the laser module top surface and is typically placed on the underside of barrel 8 to receive the barrel in the base member groove. Cover member 144 is aligned with the base member and placed over the barrel to receive the barrel in the cover member groove. The base and cover members further include a plurality of openings defined therethrough, with each opening preferably defined toward a corner of a respective member. The openings are aligned when the base and cover members surround the barrel, and are typically threaded to receive threaded bolts or other fasteners 146. The bolts secure the members together about the barrel and fasten the laser module to the firearm.

Laser module 4 includes a housing 25 including receptacles or other engagement members defined therein (not shown) for attaching the laser module to the base member bottom surface. The laser module components are disposed within the housing and include a power source 27, typically in the form of batteries, a mechanical wave sensor 29 and an optics package 31 including a laser (not shown) and a lens 33. These components may be arranged within the housing in any suitable fashion. The optics package emits laser beam 11 through lens 33 toward target assembly 10 or other intended target in response to detection of trigger actuation by mechanical wave sensor 29. Specifically, when trigger 7 is actuated, the firearm hammer impacts the firearm and generates a mechanical wave that travels distally along barrel 8 toward bracket 3. As used herein, the term "mechanical wave" or "shock wave" refers to an impulse traveling through the firearm barrel. Mechanical wave sensor 29 within the laser module senses the mechanical wave from the hammer impact and generates a trigger signal. The mechanical wave sensor may include a piezoelectric element, an accelerometer or a solid state sensor, such as a strain gauge. Optics package 31 within the laser module generates and projects laser beam 11 from firearm 6 in response to the trigger signal. The optics package laser is generally enabled for a predetermined time interval sufficient for the target assembly to detect the beam. The beam may be coded, modulated or pulsed in any desired fashion. Alternatively, the laser module may include an acoustic sensor to sense actuation of the trigger and enable the optics package. The laser module is similar in function to the laser devices disclosed in the aforementioned patent and patent applications. The laser assembly may be constructed of any suitable materials and may be fastened to firearm 6 at any suitable locations by any conventional or other fastening techniques.

Figure 3:
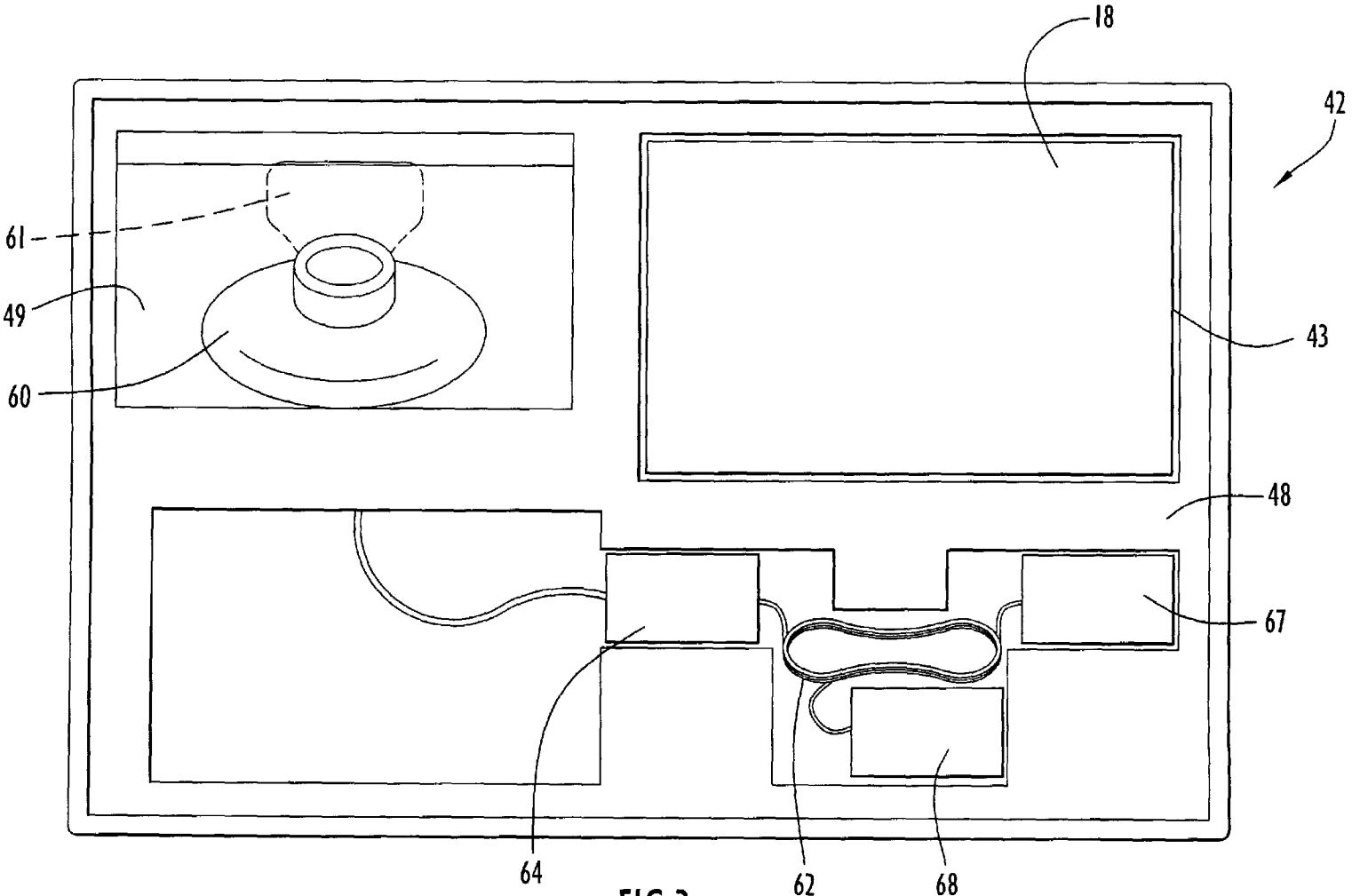
FIG. 3 is a top view in plan of the base unit of the system of FIG. 1A.

The target assembly for detecting laser beam impact locations is illustrated in FIGS. 1A and 3. Initially, the target assembly is housed within a carrying case 40. The case is typically waterproof and shockproof and includes a base unit 42 pivotably connected to a cover unit 44. The base and cover units are in the form of generally rectangular tubs or basins that collectively define a storage area within the case for storing the system. The base and cover units are pivotably connected to each other along adjoining longer dimensioned sides by a hinge type mechanism, and each unit includes corresponding fastening devices 45 disposed along the remaining sides to secure the case in a closed state. Support members 41 are connected between the base and cover units to enable the case to remain in an open state with the cover unit positioned at an appropriate angle (e.g., 90°) relative to the base unit. In addition, one or more handles may be disposed at any suitable locations along the base and/or cover units to facilitate transport of the case.

Base unit 42 includes a detection device 60, an optional barcode reader 61 (FIG. 3), an optional Universal Serial Bus (USB) hub 64, USB extension devices 67, 68 and a cable set. The cable set includes a power cord and a USB cable 62 of sufficient length (e.g., typically thirty meters and extendable to 300 feet) to extend to computer system 18, typically located near a user and at a moderate distance from the target or case during training. The detection device is preferably a USB device (e.g., camera) that is either connected to USB extension device 68 (e.g., when the bar code reader is absent) or to self-powered USB hub 64 (e.g., when the bar code reader is present). The USB hub is typically connected to the barcode reader (e.g., via an adaptor), while a USB hub host interface is connected to USB extension device 68. The USB hub may further control and/or support additional USB devices of the target assembly (e.g., human interface devices, digital I/O boards, etc.). The USB extension devices allow the standard USB signals and power to be extended over longer distances (e.g., up to 300 feet). USB extension device or unit 67 is typically local to (e.g., disposed toward) computer system 18, while USB extension device or unit 68 is remote from the computer system (e.g., disposed toward the target or case). The devices are interconnected via a standard category five (CAT 5) network cable and generally enable transmission of signals between the detection device (and optional bar code reader) and computer system. Either or both of the local and remote units may receive an external power adaptor to provide current to any USB devices.

The inside area of the cover unit is made rigid and covered with a plastic material to make a smooth, visually appealing surface. A target display area 70 is located on the left half of the inside of the cover unit (e.g., as viewed in FIG. 1A) and is covered with a piece of smooth material suitable to accept magnetic attachments (e.g., a magnetic board). The right half of the inside area of the cover unit (e.g., as viewed in FIG. 1A) includes a target storage area 72 including a pocket formed by a combination of plastic and foam which is used to store targets 80. Targets are created by applying a scaled target image or scene to a magnetic material, thereby creating a magnetic target suitable for attachment to the smooth material on the target display area 70. For exemplary purposes, targets are printed out on suitable paper using a color printer (e.g., Inkjet) and applied to a piece of PSA (pressure sensitive adhesive) magnetic material, which is essentially an adhesive-backed piece of flexible magnetic material. It should be appreciated that any material may be used for the target and the target display area (e.g., photos, plastic, metal, etc.) and any appropriate method may be used to attach a target or targets to the target display area.

In addition, any quantity of imagery components (e.g., shrubs, backgrounds, rocks, buildings, etc.) maybe added to the target scenario by simply adding them to the target display area. These imagery components are typically smaller in dimension than the larger target, and may be trimmed around their border and stacked on top of the current target. This essentially allows the end-user to customize a particular training scenario by simply sticking these scenery components on an existing target (e.g., partially obscure an engageable enemy by placing a boulder imagery component over the lower part of the enemy's body, etc.). Alternatively, background overlays maybe integrated into the printed targets themselves. The overlays may be in the form of illustrations or digital images captured from actual mission sites via a standard or digital camera. Atmospheric conditions may also be indicated by the addition of indicators using the same stacking method (e.g., providing flags to indicate wind direction and speed, etc.).

Base unit 42 includes foam insulation 48 within the case. The foam insulation may be arranged within the base unit to form pockets or open compartments for containing various system accessories (e.g., software documentation, etc.). Moreover, the base unit typically includes a compartment 43 to contain computer system 18 in the form of a laptop computer configured with system software. The case is typically positioned in a horizontal position during system operation, with longer dimension sides of the base unit contacting a support surface (e.g., table, ground, floor, etc.) and the cover unit being in a vertical open and locked position substantially perpendicular to the base unit, thereby exposing the target area to the user.

Barcode reader 61 is typically disposed within a compartment formed by the foam insulation in the base unit (FIG. 3). Targets utilized with the system of the present invention typically include a barcode that may be scanned by the barcode reader. The barcode reader scans the barcode on the target and provides scanned information (e.g., via the USB cable) to the computer system to allow the computer system to identify the target selected for a particular training activity. When the bar code reader is not employed, a serial number, typically affixed to target 80, is entered into computer system 18 by a user to indicate the target employed for a training session.

Detection device 60 is housed within base unit 42 and includes a mounting unit and a USB cable. The detection device is pointed at the target display area and positioned such that laser beam hits on the target display area may be detected and processed by the detection device. By way of example, the detection device is a CCD or CMOS image sensor utilizing a USB interface and employed as a digital camera. Base unit 42 includes foam insulation support member 49 that substantially covers the bar code reader and supports detection device 60 in a position overlying the barcode reader within the base unit. The mounting unit for the detection device is typically a multidirectionally adjustable unit that allows for alignment of the detection device in multiple planes and rotations. For example, the mounting unit may contain a multi-axis geared tripod head with ball joints at both ends to allow for horizontal, vertical, rotational and angular adjustments of the detection device with respect to support member 49. The detection device detects laser beam hits on the target area and generates appropriate detection signals in the form of captured images which are transmitted to the computer system via the USB interface (e.g., the USB hub, USB cable and/or USB extension devices). The computer system analyzes the detection signals received from the detection device and provides feedback information via display monitor 54 and/or a printer (not shown). The detection device and computer system operate to capture and process images and detect beam impact locations on the target within these images in substantially the same manner disclosed in U.S. patent application Ser. No. 09/878,786. Computer system 18 may be selected to include enhanced processing power, thereby enabling processing of higher resolution images (e.g., including greater quantities of pixels or bits) for enhanced accuracy.

Target images are scaled in order to simulate ranges from approximately twenty-five meters to approximately one-thousand meters. A target image may be available in an image set having images scaled for particular simulated ranges which may be further expanded by modifying user training distances. The scaling of targets is a linear function of perspective. Accordingly, the combination of modifying the printed scale of the target with the distance the user is from the target (i.e., the "training distance") reduces the number of printed targets required to achieve a variety of simulated distances. The system performs appropriate calculations to simulate any desired range, while a user projects a beam from the firearm at a distance corresponding to the selected scaled target.

In order to enable a user to be positioned a proper distance from a scaled target, the system may further include a conventional laser range finder. This device determines distance between objects based on transmission and reception of a laser beam. Basically, the device is transported to a location and directed toward the target to enable the device to determine the location distance from the target. Thus, the device rapidly determines a user or shooter position appropriately distanced from the target for a training session. Further, the simulated target distances may be easily modified, while the range device provides the appropriate location sufficiently distanced from the target for the modified target distance. In other words, the range finder basically automates the process of manually determining a position located an appropriate distance from the target to conduct a training session. The range finder may be disposed with the system in case 40 for storage.

In order to account for and simulate various conditions (e.g., distance, environmental conditions and any other appropriate factors), the computer system calculates cumulative offsets of the beam impact location for both the "x" and "y" location coordinates on the target display area. The offsets are applied using the proper scale for the displayed image on the computer system. The offsets are further calculated such that they produce the same effects as would be present if the user fired live ammunition in a real or "live" scenario. Thus, the system of the present invention is capable of selectively replicating conditions that affect "live" exercises and requires the user to utilize the same skill sets and procedures that would be required during such "live" exercises.

A user adjusts scope 16 to account for varying ranges and atmospheric conditions. In order to simulate targets at extended ranges in a confined area, computer system 18 determines a target offset based on target range and conditions entered by the user or other operator (e.g., instructor, training administrator, etc.). The computer system determines a target impact location by applying the offset to the impact locations determined from the images captured by the detection device. In response to a user adjusting scope 16 for specified conditions, the point of aim of the firearm for the target image is offset and the emitted laser beam effectively impacts the target display area offset from the intended site on the target image. The computer system determines the impact location with respect to the target image in accordance with the offset and beam impact locations derived from the captured images, and provides a display indicating the determined impact location with respect to the target as described below. The determined target impact locations are generally displayed by the computer system to the user, while the actual beam impact locations on the target are typically not residually visible on the target display area since a short pulse is emitted by the laser transmitter assembly.

The system maybe utilized with various types of target images. Target characteristics are contained in files that are stored on computer system 18. In particular, a desired target image is photographed and/or scanned prior to system utilization to produce target files and target information. The target files include a parameter file, a display and print image file and a scoring image file. The parameter file includes information to enable the computer system to control system operation. By way of example only, the parameter file may include the filenames of the display and scoring files, a scoring factor, simulated range and cursor information (e.g., for indicating determined target impact locations). Indicia, preferably in the form of substantially circular icons, are overlaid on these images to indicate determined target impact locations, and typically include an identifier to indicate the particular shot (e.g., the position number of the shot within a shot sequence). The scoring image is a scaled image of the target having sections or zones shaded with different colors. The colors are each associated with a corresponding value to determine a user score and the target priorities. When impact location information or captured images are received from the detection device, computer system 18 determines the target impact locations (e.g., the impact locations derived from the captured images with appropriate offsets applied thereto) and translates that information to coordinates within the scoring image. The color associated with the image location identified by the translated coordinates indicates a corresponding scoring value. In effect, the color scoring image functions as a look-up table to provide a scoring value based on coordinates within the image pertaining to a particular determined target impact location. The value of a determined target impact location may be multiplied by the scoring factor within the parameter file to provide scores compatible with various organizations and/or scoring schemes. Thus, the scoring of the system may be adjusted by modifying the scoring factor within the parameter file.

The produced files along with scaling and other information (e.g., produced based on user information, such as range) are stored on computer system 18 for use during system operation. In addition, target files may be downloaded from a network, such as the Internet, and loaded into the computer system to enable the system to access and be utilized with additional targets.

Figure 4:
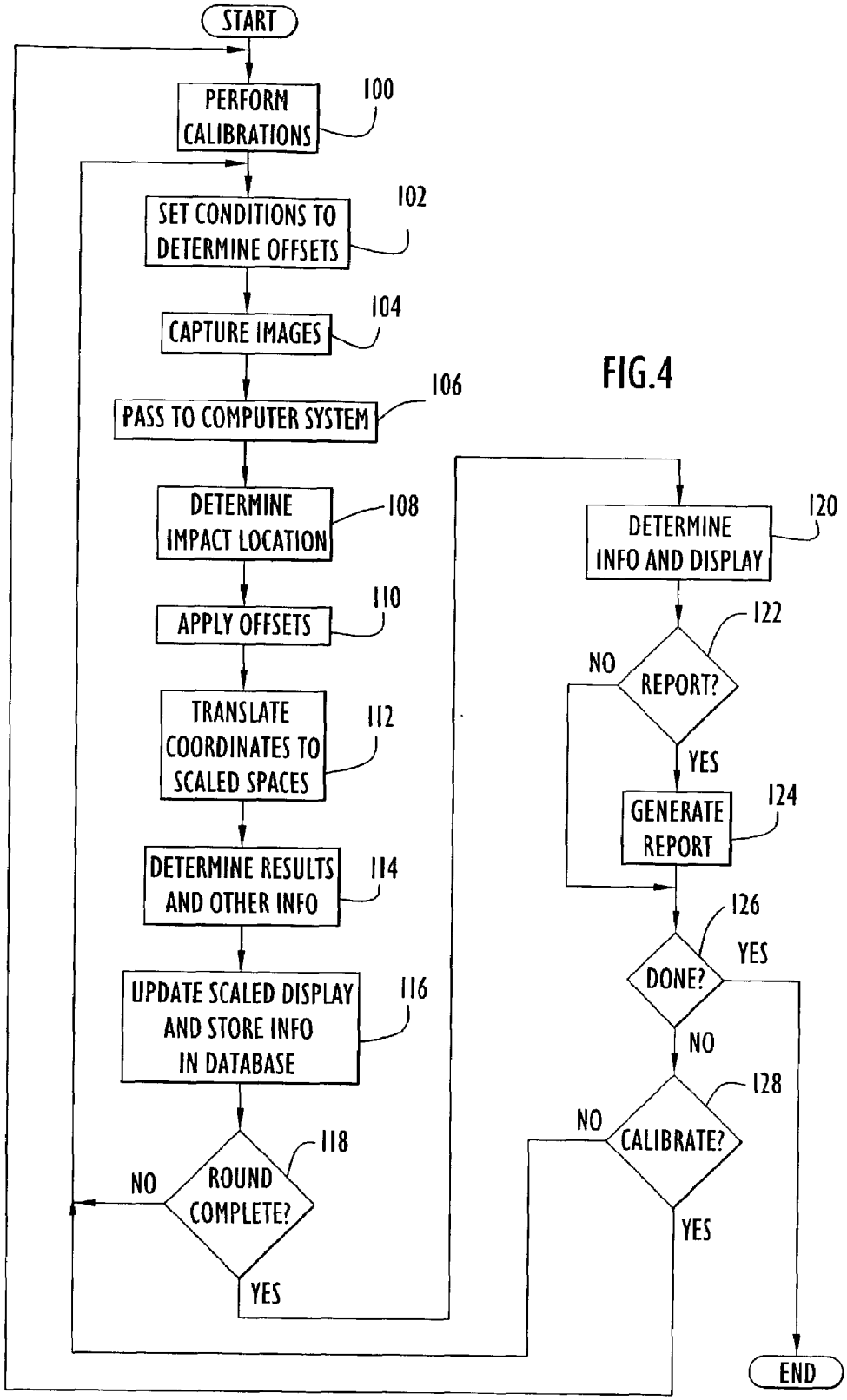
FIG. 4 is a procedural flowchart illustrating the manner in which the system of FIG. 1A processes and displays laser beam impact locations according to the present invention.
Figure 5:
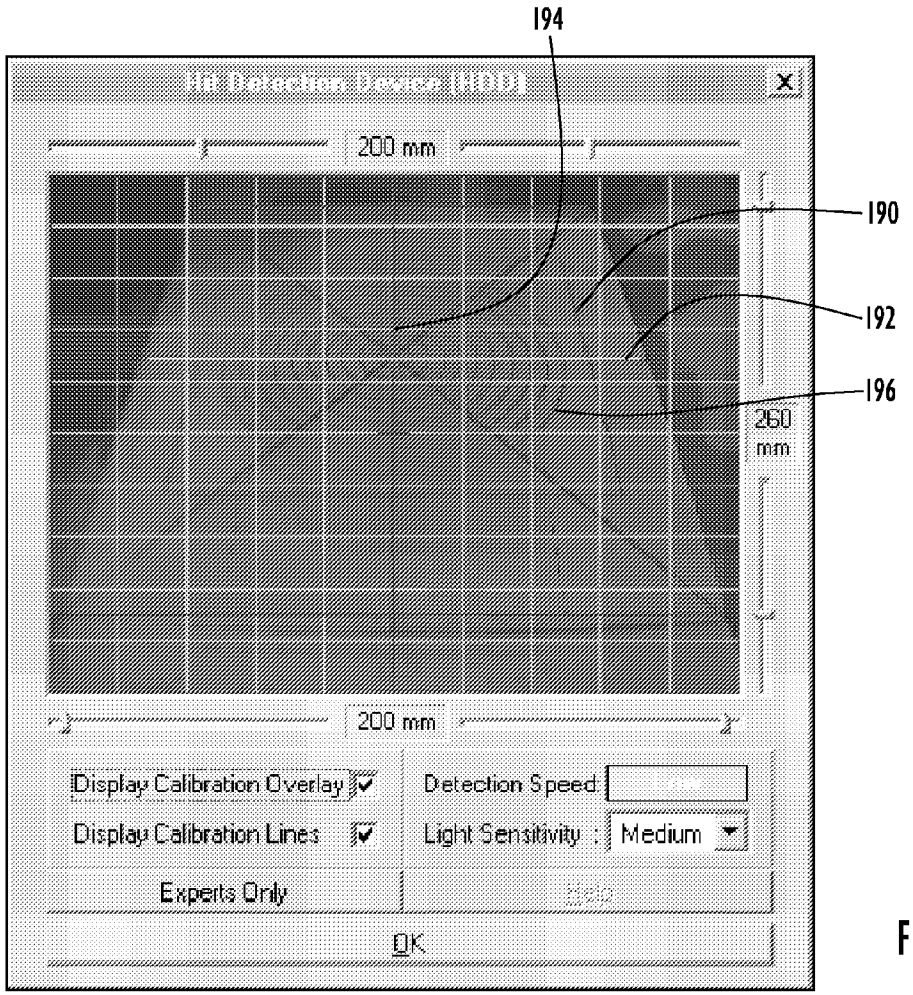
FIGS. 5-8 are schematic illustrations of exemplary graphical user screens displayed by the system of FIG. 1A for firearm activities.

Computer system 18 includes software to control system operation and provide a graphical user interface for displaying user performance. The software is preferably implemented in the Delphi Pascal computer language, but may be developed in any suitable computer language, such as 'C++'. The manner in which the computer system monitors beam impact locations and provides information to a user is illustrated in FIG. 4. Initially, the target assembly case is positioned as described above for system operation. Wind velocity and direction cues are additionally included within the system for placement at a target site. A calibration is performed at step 100 to confirm alignment of the target display area with the detection device, during which time the computer system determines lighting conditions based on captured images and, in response, adjusts parameters of the detection device for optimum performance in the current environment (e.g., this may be accomplished in the manner disclosed in U.S. patent application Ser. No. 09/878,786). The computer system display may also superimpose a grid or series of alignment guides on top of the image of the target transmitted by the detection device. An exemplary graphical user screen that facilitates calibration of the system is illustrated in FIG. 5. The target affixed to the target display area may be moved slightly to achieve ideal alignment with the detection device. In addition, alignment guides on the screen may be adjusted for position and perspective. Perspective adjustments are typically accomplished using three horizontal alignment guides and one vertical alignment guide, while utilizing a special calibration target placed on the target display area. By way of example only, the calibration target may be a properly sized printed target. The calibration target typically includes a substantially rectangular area with a thick-lined border 190 (e.g., 3 pt) around the perimeter of the detectable target area (e.g., a predefined area of all targets for which laser beam impacts may be readily detected and processed as hits, as opposed to areas outside of the field of view of the detection device) containing a heavy horizontal line 192 and a heavy vertical line 194. The heavy horizontal and vertical lines intersect perpendicularly at the center of the target and divide the target into four equal quadrants. A series of concentric circles 196 with a fixed distance between adjacent circles may be placed within the area defined by the thick-lined border. The vertical line of the target must be aligned with the vertical alignment guide on the display by physically moving the camera or target, or by adjusting the alignment guide on the display via the graphical user interface. The top and bottom horizontal alignment guides (e.g., lines) of the display are adjusted, using the graphical user interface, to be of substantially equal length to the top and bottom edges of the detectable target as defined by the perimeter lines, respectively.

Figure 6:
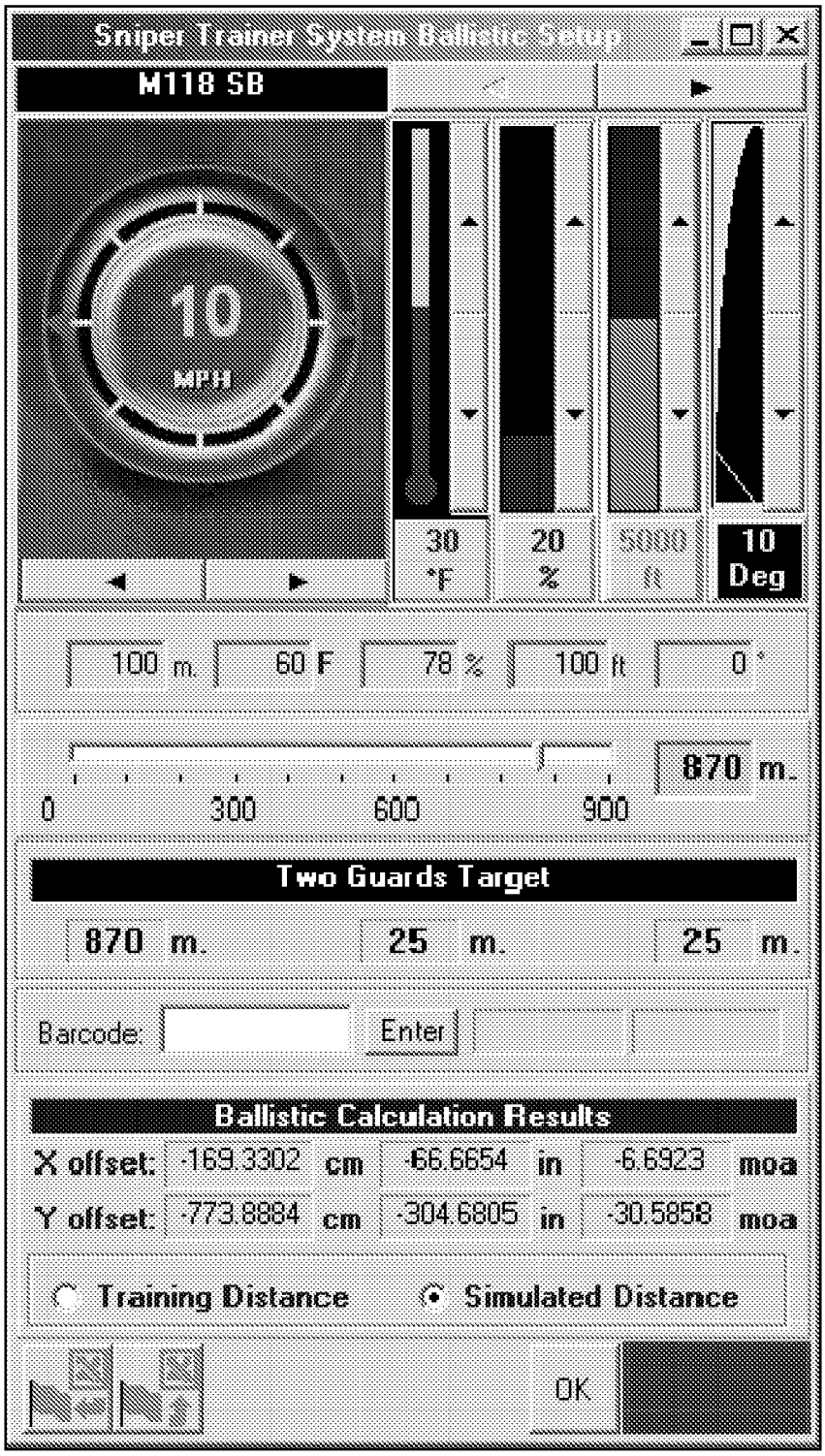

When properly aligned and of correct size, the center horizontal alignment guide should coincide with the horizontal line intersecting the center of the target and be equal in width to the detectable target area in that position. Essentially, the user will typically see a trapezoidal image of the target on the display, with the larger end at the bottom being consistent with standard perspective. A slight curvature may occur at the edges of the target display due to the shape of any lenses on the detection device. Upon proper alignment of the detection device with the detectable area, suitable targets may be used for normal operation of the system. The calibration is typically performed at system initialization, but may be initiated by a user via computer system 18. Subsequently, the particular range, atmospheric and other conditions are entered into the computer system at step 102. The computer system may display a set-up or other screen in response to the entered conditions. An exemplary graphical user screen for facilitating the entry of atmospheric and other conditions is illustrated in FIG. 6.

Once the target is positioned, a user may commence projecting the laser beam from the firearm toward the target assembly. The user adjusts scope 16 in accordance with the entered conditions and actuates the firearm to project a laser beam at target image 80 (FIG. 1A). The detection device detects the laser beam impact location and subsequently transmits detection signals, typically in the form of target images captured at step 104 and including detected beam impact locations on the target images, to computer system 18 for processing at step 106.

The computer system determines the impact location with respect to the target image at step 108 and applies the calibration offset and a trajectory offset at step 110 determined from the entered conditions as well as any system or user defined offsets. In other words, the computer system determines an overall offset between the point of aim and point of impact and applies the offset to the impact locations derived from the captured images (e.g., overall X and Y offsets are respectively applied to the X and Y coordinates of the impact locations) to simulate impact on the target image. In particular, computer system 18 stores various tables each having information relating to the particular firearm, ballistics and conditions employed for the training activity. The computer system may also store and utilize additional offsets derived from user input, target definition field, or any other source. Computer system 18 utilizes this information to determine the calculated trajectory offset of an actual projectile propelled from the firearm and seeks to replicate the offset between the point of aim and the point of impact. The trajectory and calibration offsets are applied to the derived impact locations to determine the point of impact with respect to the target image. The computer system may utilize a ballistic modeling program or module independent of the system software, such as a user defined input (e.g., a shooter's data card derived from a "live fire" experience) or any other method that provides information for the tables pertaining to a particular scenario. In an exemplary embodiment, the computer system includes a ballistic software interface that intercepts ballistic data written to a window display of the computer system by a conventional ballistic calculation or other program running simultaneously with other system software. The interface copies the intercepted data and stores the copied data within an appropriate database or other file in the computer system so that the data can be utilized to calculate adjusted impact positions on targets due to ballistic effect and other conditions. The stored data may be retrieved from within the system and utilized for virtually any bullet type or caliber. The ballistics program and interface are typically executed prior to a session to generate the tables.

The conditions are entered into the system (e.g., by a user, an appropriate interface, etc.) and provided to the ballistics module in order to produce a table having trajectory offsets for X and Y coordinates due to the conditions. The offsets are combined with the derived impact locations to determine impact locations relative to the target image. Alternatively, the ballistics module may be incorporated into the system software and automatically produce tables having trajectory offsets. When similar conditions are entered, the system searches the tables for those criteria to ascertain the appropriate trajectory offsets. The computer system may further include pull-down menus or other user interfaces to enable users to select various condition parameters (e.g., wind velocity, wind direction, temperature, altitude, barometric pressure, humidity, slope, etc.), while the ballistic module utilizes this information to provide information for the tables to determine trajectory offsets. The ballistic module may initially utilize a commercially available software package and may further be adapted to accommodate data supplied by the user. The ballistic module may also use calculations or formulas to determine offsets, with or without the production of tables (e.g., Ingalls-Mayevski ballistic calculation formula, standard published or unpublished formulas, custom developed calculations or any other source).

In addition, the trajectory information may be supplied from a user and include data measured from live fire at specified distances or ranges. This information is typically maintained for the firearm in a shooter's data card. The computer system may generate the data card for an individual weapon and may utilize this information to determine trajectory offsets, to produce training scenarios and/or scoring in accordance with actual firearm performance. Further, the user may selectively modify trajectory offsets generated by the computer system to correspond with information maintained in the firearm data card.

The computer system includes target files including target information and scaled images as described above. Since the scaling of the scoring/zoning and display images is predetermined, the computer system translates the target impact location (e.g., derived impact location with applied offset) into the respective scoring/zoning and display image coordinate spaces at step 112. Basically, the scoring/zoning and display images each utilize a particular quantity of pixels for a given measurement unit (e.g., millimeter, centimeter, etc.). The pixel quantities of each of the scoring and display images are applied to the target location to produce translated coordinates within each of those coordinate spaces, and optionally an offset may be applied to the coordinates to accommodate target scale, positioning, etc.

Computer system 18 determines appropriate offsets and beam impact locations relative to a target positioned at any location on the target display area. Thus, this configuration may determine beam impact locations without requiring precise placement of the target image. In addition, the target assembly may facilitate use of multiple target images, thereby enabling a greater range of training activities, assignment of priority to each target, and classification as enemy, friendly, non-engageable or any other category.

Figure 7:
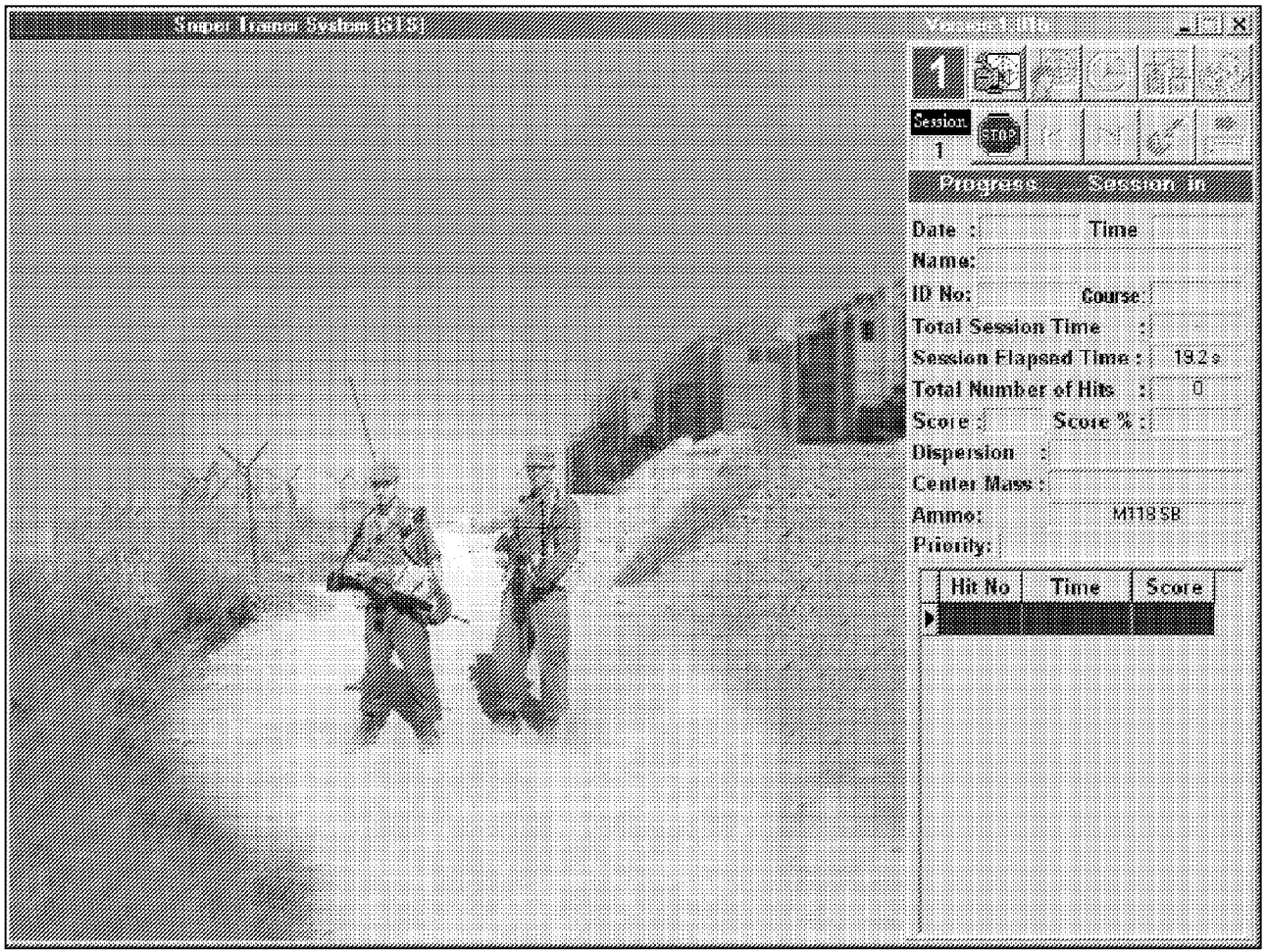
Figure 8:
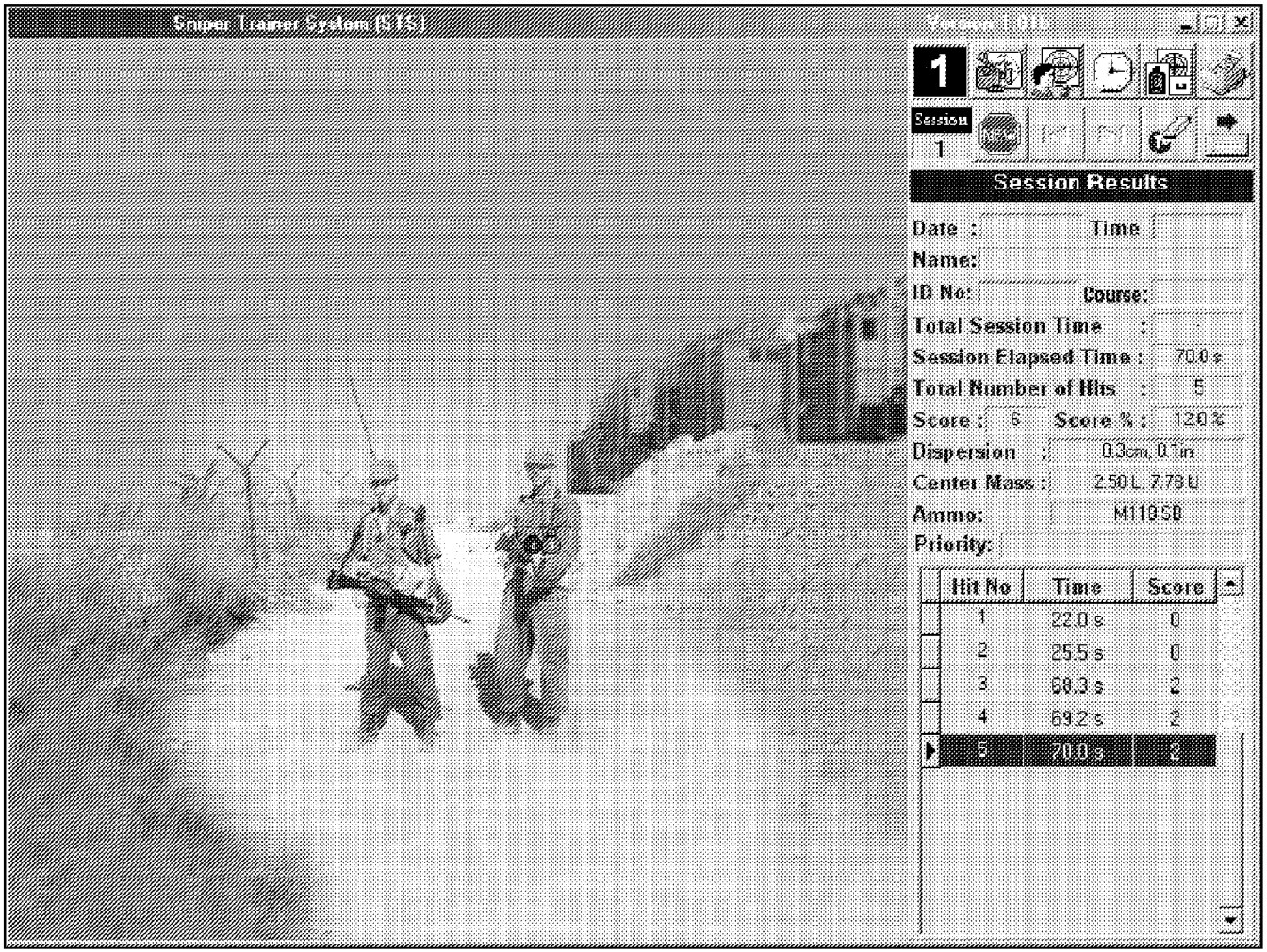

The translated coordinates for the scoring/zoning image are utilized to determine the results for the target impact at step 114. Specifically, the translated coordinates identify a particular location within the scoring/zoning image. Various sections of the scoring/zoning image are color coded to indicate a value or classification associated with that section as described above. The color of the location within the scoring image identified by the translated coordinates is ascertained to indicate the classification of the target impact to determine hit/miss, appropriateness of individual target selection (when more than one object of interest exists in a given scenario) and evaluation of sequence in which the targets are engaged (fired upon). The zoning factor within the parameter file is applied as specified in the associated parameter file for each target to determine a score or other evaluation for the target impact. The score and other impact information is determined and stored in a database or other storage structure, while a computer system display showing the target is updated to illustrate the target impact location and other information at step 116. Types of information that may be displayed include, without limitation, shot group size, center of mass, time interval between shots, natural dispersion, mean point of impact, offset of impact from center of target (e.g., quantity of units above, below, left or right of target, specific to individual targets when more than one object of interest exists), impact score, cumulative score, etc. The display image is displayed, while the target impact location is identified by indicia that are overlaid with the display image and placed in an area encompassing the translated display image coordinates. Further, the display may include a graphic overlay having a scaled minute of angle grid (FIG. 13) as described below to enable a user to analyze performance with respect to a measurement reference. In addition, the display may include information pertaining to the entered conditions in a format similar to a firearm data card. Exemplary graphical user screens indicating the target, target impact locations, impact time, score and other information for a particular training session are illustrated in FIGS. 7 and 8.

If a round or session of firearm activity is not complete as determined at step 118, the user continues actuation of the firearm and the system detects target impact locations and determines information as described above. However, when a round or session is determined to be complete at step 118, the computer system retrieves information from the database and determines information pertaining to the session at step 120. The computer system may further determine grouping circles. These are generally utilized on shooting ranges where projectile impacts through a target must all be within a circle of a particular diameter. The computer system may analyze the target impact information and provide groupings and other information on the display that is typically obtained during activities performed on firing ranges (e.g., dispersion, etc.). The grouping circle and target impact location indicia are typically overlaid with the display image and placed in areas encompassing the appropriate coordinates of the display image space in substantially the same manner described above.

When a report is desired as determined at step 122, the computer system retrieves the appropriate information from the database and generates a report for printing at step 124. The report includes the print image, while target impact location coordinates are retrieved from the database and translated to the print image coordinate space. The translation is accomplished utilizing the pixel quantity for a given measurement unit of the print image in substantially the same manner described above. The target impact locations are identified by indicia that are overlaid with the print image and placed in an area encompassing the translated print image coordinates as described above for the display. The size of impact identifying indicia displayed on the target image may be selected to correspond with a shot size representative of a round of ammunition for a particular firearm utilized in a training scenario. The report further includes various information pertaining to user performance (e.g., score, dispersion, mean point of impact, offset from center, etc.). When another session is desired, and a calibration is requested at step 128, the computer system performs the calibration at step 100 and the above process of system operation is repeated. Similarly, the above process of system operation is repeated from step 104 when another session is desired without performing a calibration. System operation terminates upon completion of the training or qualification activity as determined at step 126.

Operation of the system is described with reference to FIG. 1A. Initially, case 40 is opened and arranged as described above. A target 80 is selected and placed on target display area 70, while corresponding target files containing target information are produced and stored in the computer system. Laser module 4 is attached to barrel 8 of firearm 6 as described above. The laser module is actuated in response to depression of firearm trigger 7. Any of the lasers or firearms disclosed in the above-mentioned patent and patent applications may be utilized (e.g., systems employing dry fire or modified blank cartridges). The computer system is commanded to commence a firearm activity, and initially performs a calibration as described above. A calibration target is placed on the target display area of the cover unit and the computer system performs a calibration, which is typically displayed on a graphical user screen (FIG. 5). Once the calibration is performed, the user may optionally set atmospheric and other conditions utilizing graphical user screens (FIG. 6), for which the computer system will determine appropriate offsets using any of the methods described above. In response to firearm actuation by a user, the detection device captures images of the target including beam impact locations and the computer system processes the information, applies any offsets, and adjusts for appropriate scale. The computer system translates the resulting target impact coordinates into the respective scoring/zoning and display image spaces and further determines a performance evaluation corresponding to the impacted target section and other information for storage in a database as described above. The target impact location and other information are displayed on a graphical user screen (FIGS. 7 and 8) as described above. When a session is complete, the computer system retrieves the stored information and determines information pertaining to the session for display on the graphical user screen. Moreover, a report may be printed providing information relating to user performance as described above.

Figure 1B:
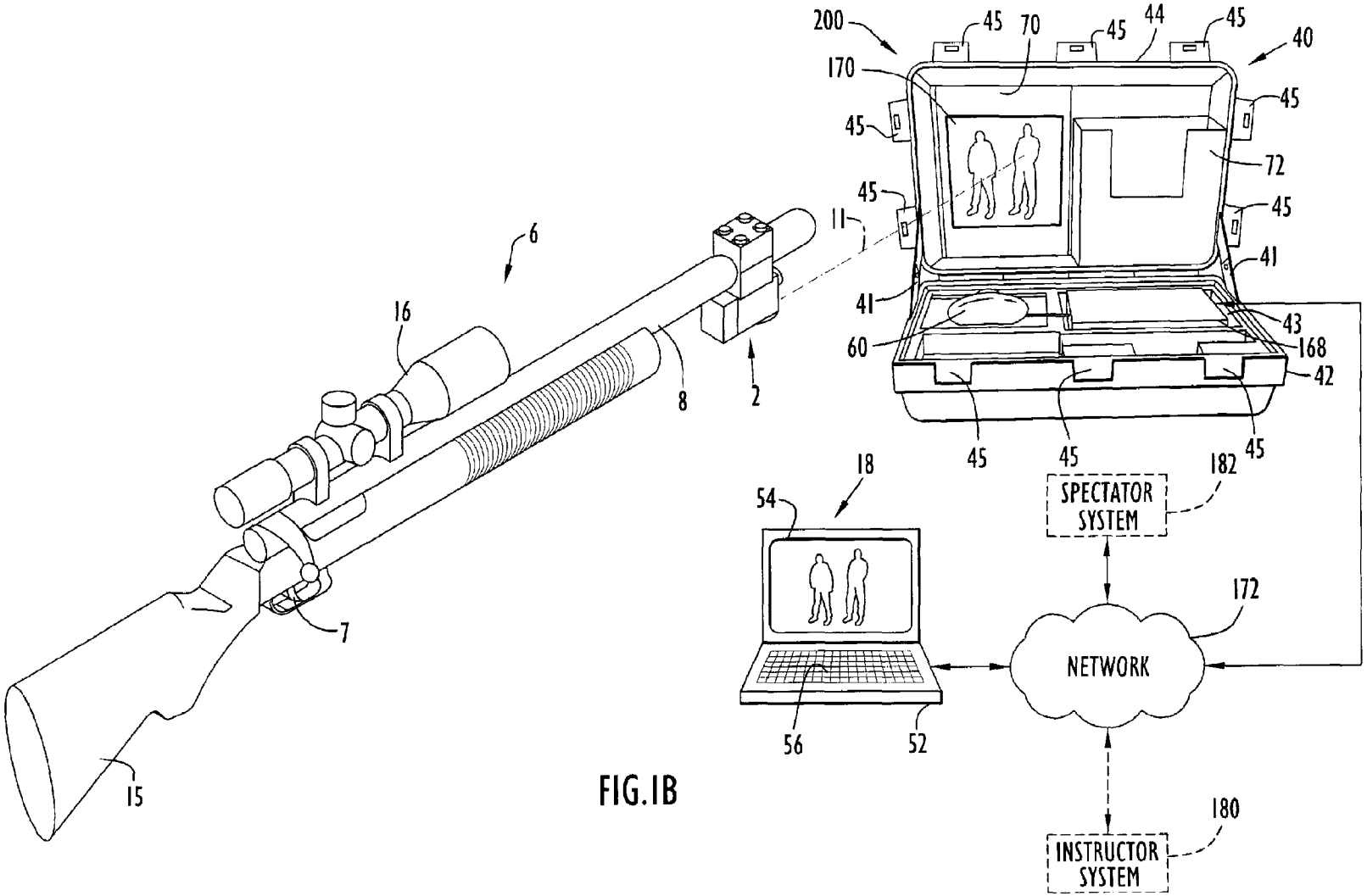
FIG. 1B is a view in perspective of an alternative embodiment of a firearm laser training system having a laser beam directed from a firearm onto a target in the form of a display screen according to the present invention.

The firearm laser training system described above may alternatively include a target assembly with a display screen to present various targets during a training session as illustrated in FIG. 1B. Specifically, the system is substantially similar to the system described above for FIG. 1A and includes firearm 6 with laser transmitter assembly 2 and a target assembly 200. Target assembly 200 is similar to target assembly 10 described above and includes case 40 with pivotally connected cover and base units 42, 44. The base unit includes detection device 60 that is coupled to a target computer system or controller 168. The detection device may be disposed within the base unit as described above, while the target controller may be disposed adjacent the detection device in compartment 43. The cover unit includes a display screen 170 (e.g., liquid crystal display (LCD), plasma, etc.) disposed in target display area 70, while storage area 72 adjacent the display area may be utilized to contain system accessories (e.g., documentation, cables, computer system 18, etc.). The display screen may be supported in the target display area by any conventional or other securing mechanisms (e.g., brackets, bands, hooks, etc.) and is coupled to and controlled by target controller 168 to display targets for a training session as described below.

Target controller 168 maybe implemented by any processor or computer system (e.g., the type of system described above for computer system 18) and is typically controlled by computer system 18 to facilitate display of targets. Target controller 168 and computer system 18 each typically include a wireless communications device (e.g., employing radio frequency (RF) signals) to enable communications between these devices via a network 172 (e.g., LAN, WAN, Internet, Intranet, etc.). Alternatively, target controller 168 and computer system 18 may access the network and/or directly communicate with each other via any suitable communications medium (e.g., wireless, wired, LAN, WAN, Internet, etc.). The wireless communication enables placement of computer system 18 near a user without utilization of the cables and USB extension devices described above for FIG. 1A.

The target controller controls display screen 170 to display a target in accordance with control signals from computer system 18. Basically, the user selects the desired target or target scenario on computer system 18 and the computer system instructs the target controller to display the selected targets on display screen 170 for the training session. The system may display targets in the form of target images, or videos showing moving targets or various scenarios (e.g., objects in a particular environment, etc.). Further, the videos may show actual shooting conditions (e.g., flags indicating wind, temperature, weather, etc.) to enable a user to identify those conditions to adjust the firearm accordingly for a training session. The images or video may be stored on the target controller or computer system 18, or be retrieved from a network site (e.g., a server system residing on the Internet). Moreover, the target controller may adjust or re-size a target image or video (e.g., zoom in or zoom out) to accommodate training at various ranges. In other words, the system may be utilized to simulate various ranges by adjusting the size of the target image or video on the display screen.

In operation, a user initially prepares the target assembly and calibrates the system as described above (e.g., the calibration target may be placed over the display screen, or the display screen may display an image of the calibration target). The desired targets for display are subsequently selected via computer system 18, and the user moves to a position an appropriate distance from the target for the training session. The user may enter the desired conditions or determine the conditions from the scenario displayed on the display screen. The user adjusts the firearm in accordance with the particular conditions and actuates the trigger to project a laser beam toward the displayed target and onto the screen. The detection device captures target images and transmits the captured images to computer system 18 for processing in substantially the same manner described above to determine target impact locations. The computer system displays the target image with target impact locations indicated thereon and additional information concerning the session to the user as described above.

In order to enable an instructor to control a training session, the system may further include an instructor computer system 180. The instructor computer system is substantially similar to computer system 18 and includes a wireless communication device to communicate with controller 168 via network 172. Thus, the instructor system may be local to or remote from the training location. The instructor system enables an instructor to enter the shooting conditions (e.g., via a screen similar to FIG. 6) and/or select the target and/or target scenario for display on display screen 170. Further, the instructor system provides information concerning the training session (e.g., target image with beam impact locations and/or statistics concerning user shooting (e.g., via screens similar to FIGS. 7-8), etc.) to an instructor overseeing the training.

The various conditions and other parameters for a training session may be entered at computer system 18 and/or instructor system 180, while these systems may display any desired information. For example, computer system 18 may display the target and impact locations, while the instructor system displays this information with additional information derived from the session (e.g., score, dispersion, etc.). The processing of captured images from the detection device may be distributed among target controller 168, computer system 18 and/or instructor system 180 in any manner, while these systems may distribute the processed information among each other in any fashion. The training system may further include a spectator system 182 that accesses the network or otherwise communicates with target controller 168, computer system 18 and/or instructor system 180 to display information concerning a training session to a third party. The spectator system may be implemented by any computer or processing system (e.g., systems substantially similar to computer system 18 and/or instructor system 180) and may be local to or remote from the training location. The spectator system may display any desired information (e.g., target image with beam impact locations and/or statistics concerning user shooting (e.g., via screens similar to FIGS. 7-8), etc.).

Figure 9:
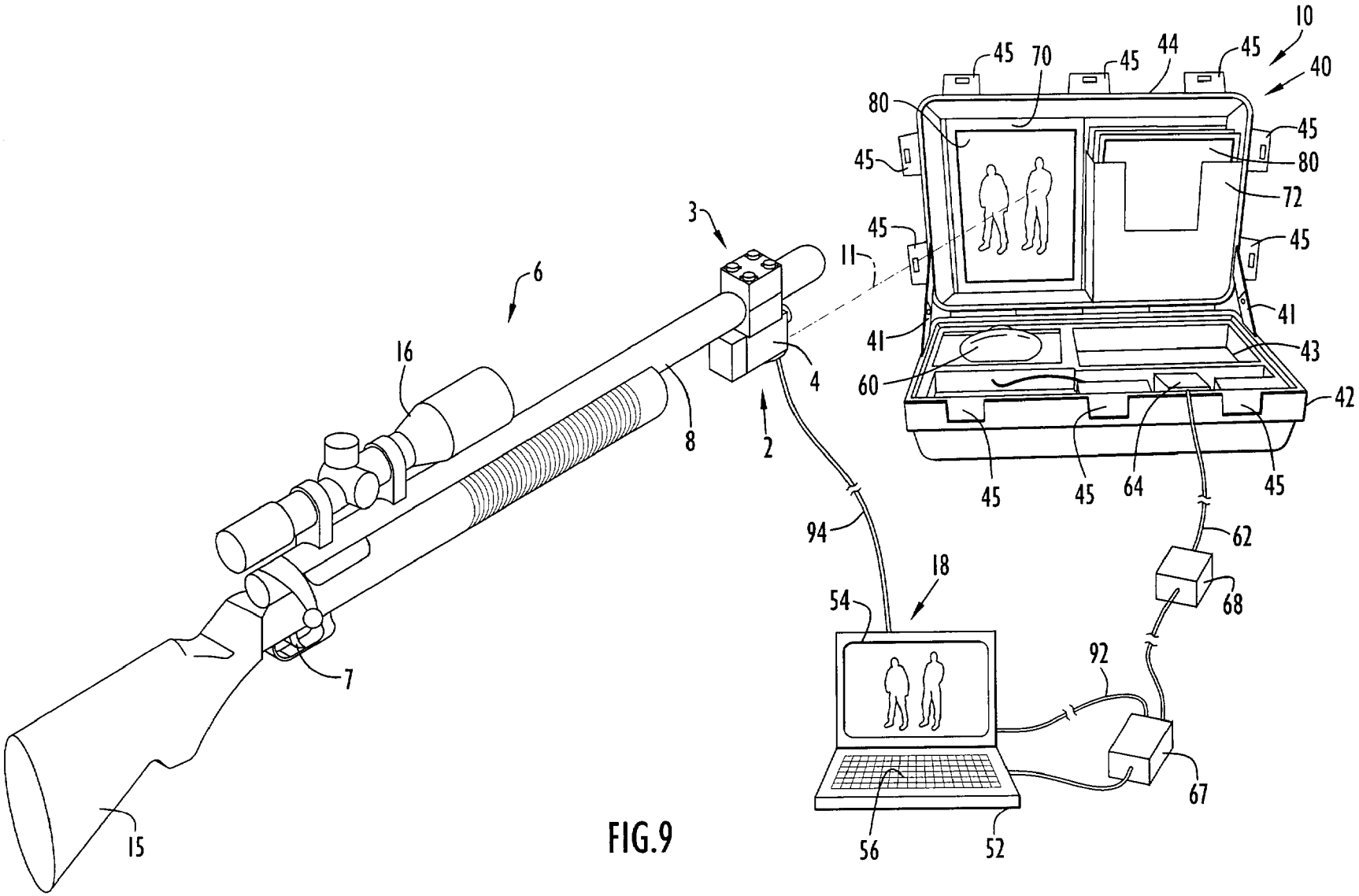
FIG. 9 is a view in perspective of another alternative embodiment of a firearm laser training system employing an electronic laser filter for beam impact detection and having a laser beam directed from a firearm onto a target according to the present invention.

The firearm laser training systems described above may include an electronic laser filter to reduce false detections of beam impacts on the target as illustrated in FIG. 9. The electronic laser filter enhances system performance by detecting laser impact locations on a target under extreme lighting or other conditions that may otherwise result in a false hit detection by the detection device. The electronic laser filter may be utilized in place of optical filters (e.g., generally employed by the systems to isolate the laser beam from ambient light) that are typically expensive and generally result in false detections or unreliable performance in extreme lighting conditions. Byway of example only, the electronic laser filter is described with reference to the system described above and illustrated in FIGS. 1A and 2-8, however, the filter may be utilized with the system of FIG. 1B in a similar manner as described below. Specifically, the system includes a laser transmitter assembly 2, a firearm 6, a target assembly 10 and a computer system 18, each substantially similar to the corresponding system components described above. In addition, the system includes an electronic laser filter including a laser interface board (LIB) incorporated into local USB extension unit 67 and a pair of cables 92, 94 respectively connecting each of the LIB and laser assembly 2 to a parallel port of computer system 18.

The laser transmitter assembly of the system typically receives power from the LIB, but may optionally include a power source or battery as described above. The laser assembly accommodates a plurality of signals including a positive power signal, a negative or reference power signal and a signal ground from a processing board (e.g., processor ground after a 1.5V signal is converted to a 5V signal for use by a processing board processor) within the laser module that interfaces laser module components to control laser operation. The positive and negative power signals provide power to the laser assembly from the LIB and allow extended 'constant on' operation without decrease in power or voltage, typically encountered with battery operation. When the laser is pulsed or the mechanical wave sensor (e.g., piezoelectric element) detects the mechanical wave as described above, a slight deviation occurs between signal ground and the negative power signals. This occurs since the laser processor board pulls additional current when the mechanical wave sensor is activated, thereby altering the signal ground signal. The LIB detects the deviation and produces an actuation signal to indicate trigger actuation.

The LIB is typically disposed within local USB extension unit 67 as described above to conserve components (e.g., power supply, housing, etc.), but may be integrated with or external of the system components. The LIB basically generates the positive and negative power signals for the laser assembly and receives the signal ground from the laser processing board. The LIB detects the deviation between the negative power and signal ground signals to determine trigger actuation. The LIB subsequently converts and buffers an actuation signal for transmission to a parallel port of computer system 18 that is configured to receive a digital signal. This technique enables a maximum of eight individual lasers to transmit signals to a single parallel port, each using a corresponding LIB.

Figure 10:
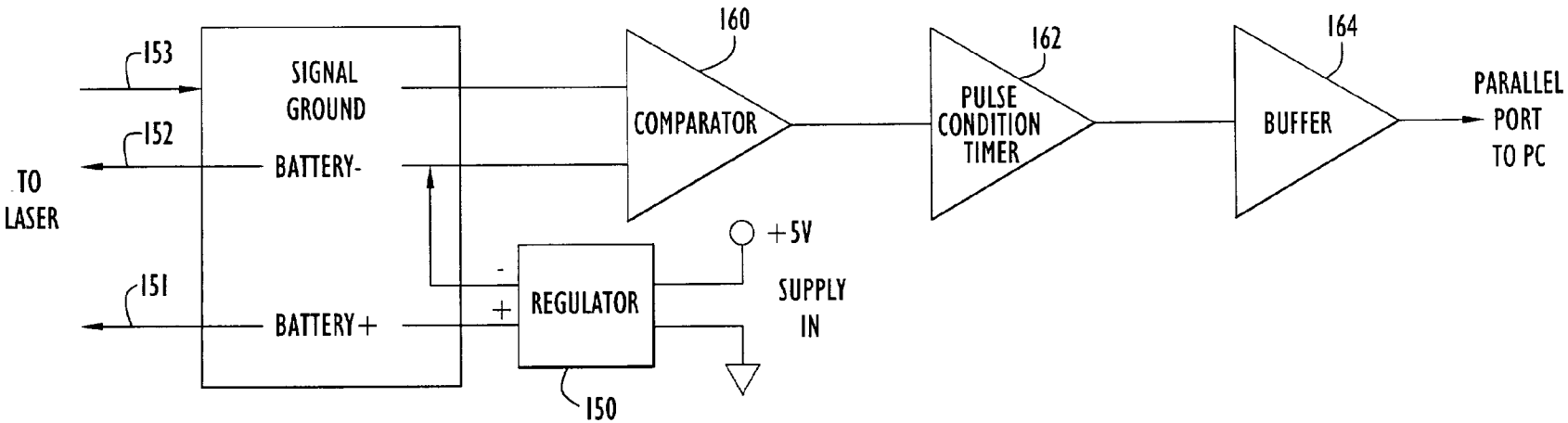
FIG. 10 is a schematic block diagram of exemplary circuitry for a laser interface board of the electronic laser filter of the system of FIG. 9.

The circuitry of the LIB is illustrated in FIG. 10. Specifically, the LIB circuitry includes a regulator 150, a comparator 160, a pulse condition timer 162 and a buffer 164. The regulator receives power from a power source (e.g., 5V DC) and supplies compatible power to laser transmitter assembly 2. Power is supplied from the regulator to the laser transmitter assembly via a pair of positive and negative LIB power terminals 151, 152, respectively. The respective positive and negative power signals from terminals 151, 152 of the LIB are supplied to the laser transmitter assembly via cables 92, 94. These cables further convey the signal ground signal from the laser transmitter assembly to LIB signal ground terminal 153. Negative terminal 152 and signal ground terminal 153 are both connected to comparator 160. When the firearm trigger is actuated, signal ground on terminal 153 deviates from the negative power signal on terminal 152 due to activation of the mechanical wave sensor (e.g., a piezoelectric element) as described above. The comparator detects this signal deviation and produces an actuation signal. A pulse condition timer 162 is connected to an output of comparator 160 and receives the actuation signal. The pulse condition timer basically enlarges the pulse width of the actuation signal for recognition by computer system 18. Buffer 164 is connected to the output of pulse condition timer 162 and buffers the processed actuation signal for transmission to the computer system parallel port. The buffer further prevents any potential damage to the computer system in the event of a short circuit. The actuation signal basically informs the computer system of trigger actuation to confirm detections of beam impact.

In operation, the user initially prepares the target assembly, selects a firearm activity, performs a system calibration, and selects atmospheric and other conditions to allow the computer system to apply appropriate offsets to detected beam impact locations in order to determine target impact locations as described above. The user adjusts the firearm in accordance with the conditions and moves an appropriate distance from the target for the training session. In response to firearm actuation by the user, the computer system detects a beam impact location on the target via the detection device in the same manner described above. Simultaneously, the computer system also receives the actuation signal from the LIB via the parallel port. The actuation signal provides confirmation that the detection device detected a beam impact location in response to trigger actuation and emission by the laser transmitter assembly, rather than a false hit detection caused by another light source appearing on the target. Conversely, if the detection device detects a beam impact location on the target due to a light source other than the laser transmitter assembly, the computer system will recognize the detection as a false hit when the actuation signal transmitted by the LIB does not indicate firearm actuation. Thus, utilizing the electronic laser filter enhances system performance by preventing the processing of false hit detections on the target as actual beam impact locations by the computer system. The computer system processes the images from the detection device in response to the actuation signal to determine and display the target impact locations as described above.

The electronic laser filter may similarly be utilized with the system of FIG. 1B. In this case, the LIB is disposed external of system components or within computer system 18 performing processing of captured images to detect impact locations. The LIB is coupled to the laser transmitter assembly and to a parallel port of computer system 18 as described above to indicate trigger actuation. The computer system processes the captured images in response to the actuation signal from the LIB to determine and display target impact locations as described above. The electronic laser filter enhances system performance by preventing processing of false hit detections.

The systems described above may also reference previous impact location information in a particular training session to assist in verifying the validity of a detected beam impact location, particularly for constant on or trace mode described below. Basically, the systems determine whether the most recent detected beam impact location lies within a predetermined range associated with a grouping of verified impact locations for that training session. For example, if a particular session already includes several verified impact locations all grouped near the target center, a detected impact location disposed near a target corner may be determined as falling outside an established grouping range and thus considered a false hit detection.

The systems described above may perform a fine zeroing adjustment for the laser transmitter assembly. In particular, this feature may be invoked by a user from a button on a system graphical user screen (e.g., FIGS. 7-8). The user fires at least two shots at a location on the target (e.g., target center) that are detected by the system. The impact locations are generally offset (e.g., on the order of millimeters) from the intended target site due to the laser transmitter configuration. The system detects the locations and produces an offset indicating adjustment of the impact locations (e.g., center of mass) to the intended target site. The offset adjustment is applied to subsequent detections during system operation to determine and display appropriate impact locations relative to the target. The zeroing procedure is typically performed manually by the user adjusting the laser transmitter, however, the automatic zeroing performed by the system provides a greater degree of accuracy. The zeroing adjustment may be performed by the systems at any desired time prior, during or subsequent a training session.

Figure 11:
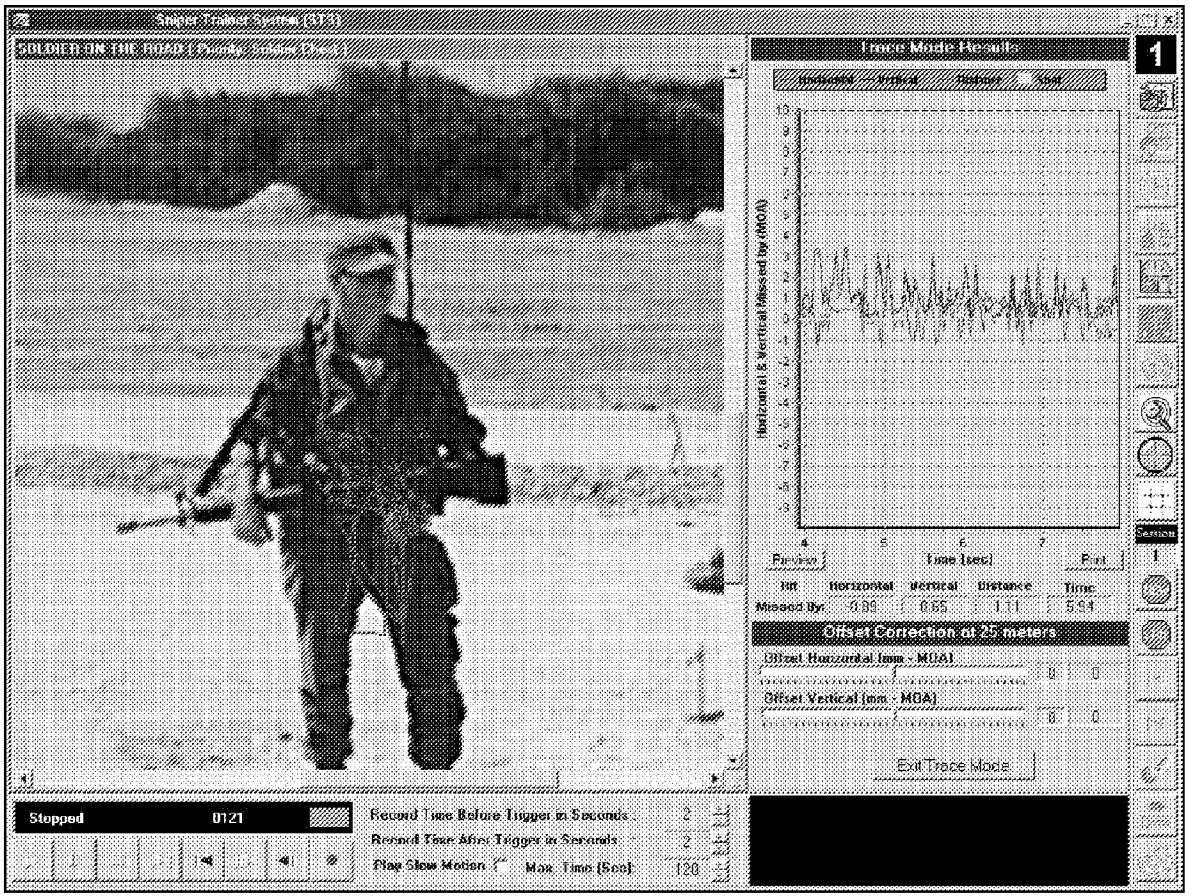
FIG. 11 is a schematic illustration of an exemplary graphical user screen displayed during a trace mode.

The system described above employing the electronic laser filter may further include a trace mode that allows computer system 18 to trace the aiming position of the firearm or laser transmitter assembly and report graphically the horizontal and vertical deviations of the firearm for a selected time period. In the trace mode, the laser transmitter assembly is configured to continuously project a laser beam from the firearm (e.g., 'constant on' mode), rather than projecting a laser beam pulse in response to actuation of the firearm trigger. The continuous laser beam projection allows the detection device to trace any movement of the firearm, which in turn, allows the computer system to provide feedback to the user relating to fluctuation in firearm aim before, during and/or after trigger actuation. In an exemplary embodiment, the computer system continuously receives detection information (e.g., target images including beam impact locations) from the detection device over a selected time period. Since the laser transmitter assembly is in a continuous mode (i.e., continuously projecting a laser beam onto the target), the detection device traces the aim of the firearm on the target and continuously relays detection information to the computer system. The computer system determines the target impact locations as described above and the time at which trigger actuation occurs based upon actuation signals received from the LIB. This enables the system to provide information for any selected intervals prior to or subsequent trigger actuation. A trace report is then compiled and displayed by the computer system to provide an indication to the user of the horizontal and vertical fluctuations of the firearm with respect to an actual and/or desired hit location on the target before and/or after trigger actuation. An exemplary graphical user screen displaying trace mode information is illustrated in FIG. 11 and includes plots of horizontal and vertical fluctuations in firearm aim over a selected time period before and after trigger actuation. The vertical and horizontal plots are typically color coded to identify a particular plot, while the time period may be set to any desired interval.

Computer system 18 of the above-described systems may be in communication with other systems via any communications medium (e.g., network, wires, cables, LAN, WAN, Internet, etc.) to facilitate sessions with plural users at the same or different locations, or enable remote monitoring of user performance by instructors. Further, the system case and components maybe constructed or adapted for any weather conditions and for indoor/outdoor use. In addition, the present invention is not limited to the targets disclosed herein, but may be utilized with any type of target. For example, the present invention may be utilized with the actuable target assemblies disclosed in U.S. patent application Ser. No. 09/862,187. Briefly, these target assemblies each raise a target (e.g., including a target image and a detection device to determine impact locations) in accordance with a timed scenario and lower the target in response to a hit or an expired scenario interval. The present invention may utilize such target assemblies where the target image is offset with respect to the target assembly detection device to account for various conditions. The computer system receives beam impact locations from the target detection device and applies trajectory and any calibration offsets in the manner described above to determine impact locations relative to the target image. A record of the firing exercise may be displayed, stored or printed as described above.

The present invention is versatile and provides training in various exercises including: visual feedback on marksmanship fundamentals; shot grouping; target detection; target identification; range estimation and elevation adjustment; wind estimation and windage adjustment; ballistic correction for weather conditions; slant range correction; fleeting target engagement; multiple target engagement; and observation and recording. For example, shot grouping may be accomplished by users firing at the computerized target from a predetermined range of approximately twenty-five meters. The default target presentation and display is the bulls-eye target. Shot groups are observed by the instructor who determines whether or not the group complies with the standard, or may recommend remediation of errors that are apparent in the shot group configuration. Shot groups having a dispersion within a particular quantity of MOA as measured by the system and displayed, are considered to comply with the minimum standards.

Target detection may be accomplished by a user team detecting a target presentation which may be camouflaged or hidden among other objects or elements serving as visual distractions in a background image. The target presentation is positioned to scale with displayed background imagery. The actuable targets described above fitted with appropriately scaled masks may be utilized to provide timed and partially obscured target presentations. In addition, the user team may identify the target by a cue on the target or by the type of target (e.g., radioman, rifleman, dog team handler, etc.) for target identification.

Figure 12:
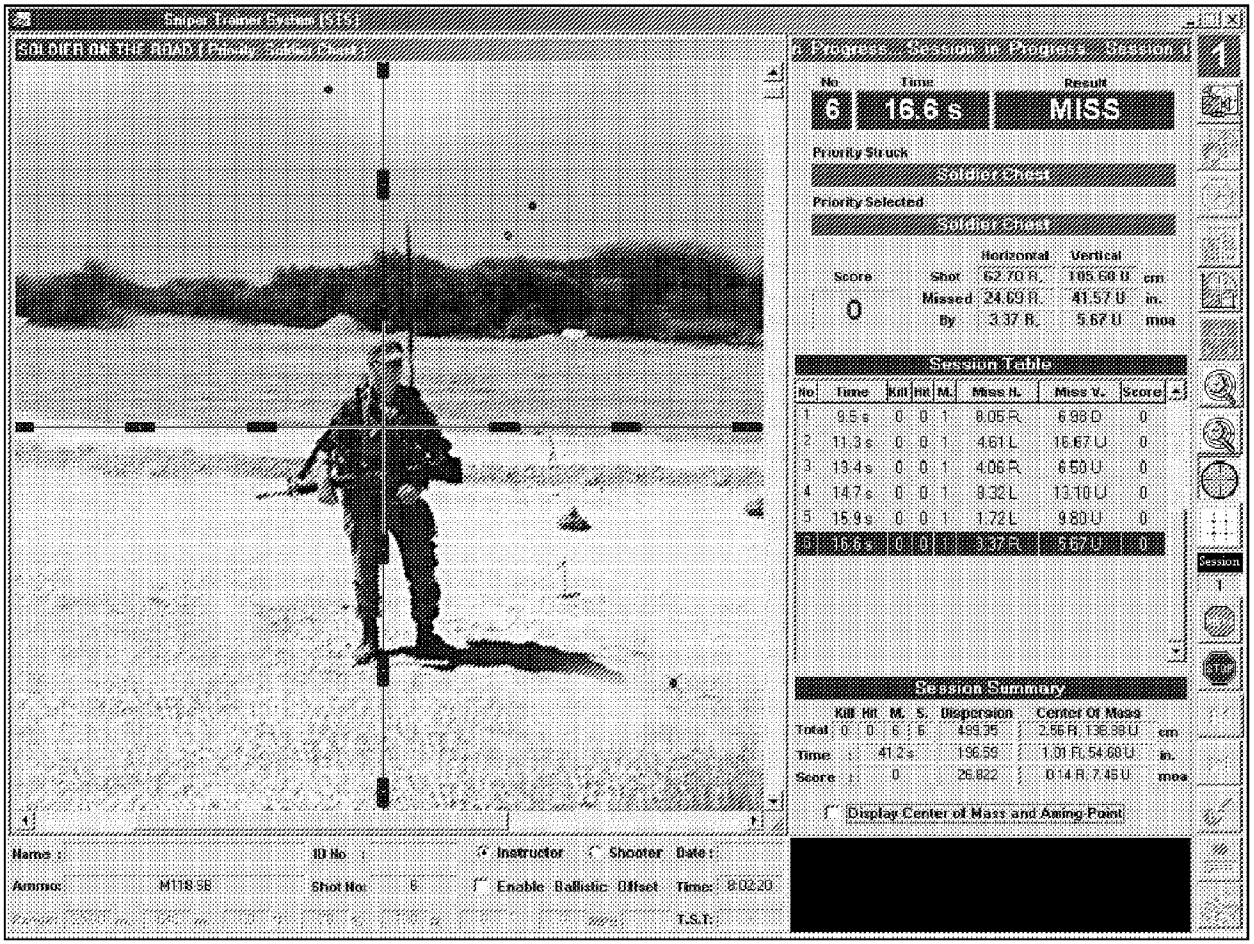
FIG. 12 is a schematic illustration of an exemplary graphical user screen with a MilDot overlay.

With respect to the range estimation and elevation adjustment exercise, one method of range estimation of precisely scaled target presentations is made using the MilDot reticle of the rifle scope, M19 or M22 binoculars or other MilDot devices. Once the range to target has been established, the user adjusts the rifle scope or employs hold off appropriate for the range. If the proper adjustment is made, subsequent shots strike the target on the computer display. Ballistics software (or an offset point of aim mask for the above-described actuable targets) may be employed to adjust the point of impact at all simulated ranges. In addition, a graphical overlay scaled for distance may be utilized on the target image displayed by the computer system to replicate the image viewed through a conventional MilDot scope. In other words, the system reproduces the scope view of the target area. MilDot is basically an industry standard high precision tool superimposed into a scope viewing area that allows shooters to estimate size of objects and thereby estimate range to a target. The system replicates this situation, allowing a user to train, evaluate or be evaluated with or without the weapon. In the absence of a weapon, the MilDot graphical overlay may be manipulated by the user, via an input device (e.g., mouse), to any location on the displayed target image to determine the simulated size of an object displayed on the target and thus a simulated target range between the user and the object. Further, the overlay may be manipulated in response to movement of the firearm and detection of the laser in a constant on mode to enable viewing of the manner in which the user adjusts the scope to determine the size and range. This is similar to the trace mode with the position of the overlay being manipulated in response to movement of the firearm. An exemplary graphical user screen providing a MilDot overlay for use with the systems described above is illustrated in FIG. 12.

Wind estimation and windage adjustment exercises may be accomplished by an instructor informing a user of the simulated wind conditions (e.g., three o'clock, 5 MPH) or providing a visual indicator such as a miniature wind flag from which to determine the wind velocity and direction. The instructor enters the wind information into the computer ballistics software, while the user makes the appropriate adjustments prior to firing. If the adjustment is correct, subsequent shots strike the target on the computer display. The user may also configure and control the scenario.

Exercises with respect to ballistic corrections for weather conditions may be performed by an instructor entering several variables into the ballistics software that affect the point of impact of the bullet. The user is informed of these variables and determines the adjustments. These weather conditions may include temperature, elevation, barometric pressure and humidity. Basically, the temperature, elevation above sea level (ASL), barometric pressure and humidity each affect the ballistic coefficient of the bullet resulting in more or less drag. If the user makes the appropriate adjustments, subsequent shots strike the target on the computer display. Exercises with respect to slant range correction may be conducted in a similar manner. Basically, the instructor enters uphill/downhill angle of the shot into the ballistics software to enable the computer system to calculate the slant range. The user may enter the correction as the angle (in degrees) given by the instructor or by estimating the slant range to the target. If the user makes the appropriate adjustment subsequent shots strike the target on the computer display.

Fleeting target engagement exercises may be accomplished by a user team engaging electronic targets mounted on the above described actuable target assemblies. The target assemblies are positioned at selected distances (e.g., approximately 25 meters) from the users. The targets are fitted with appropriate offset point of aim masks while target exposures are set by the instructor and require quick target detection, target ID and shot release. In addition, non-combatant target presentations may be mixed into the exercise. Multiple target engagement exercises may be performed in a similar manner where a user engages multiple electronic targets mounted on the actuable target assemblies and positioned at selected distances (e.g., approximately 25 meters) from the user. The targets are fitted with appropriate offset point of aim masks. Single and multiple target exposures may be set by the instructor where target presentations include targets of varying priority and non-combatant targets. The user engages targets in order of priority or threat level.

Observation and recording exercises may be accomplished by a user team moving into a position overlooking a simulated range containing several camouflaged electronic targets mounted on the above-described actuable target assemblies and positioned at selected distances (e.g., approximately 25 meters) from the user. The user prepares a range card and observes the area for a period of time (as determined by the instructor). The instructor randomly and occasionally exposes an electronic target fitted with an appropriate offset point of aim mask or scale presentation of a small object. The user team engages permitted targets and records all observations on the observation log.

Figure 13:
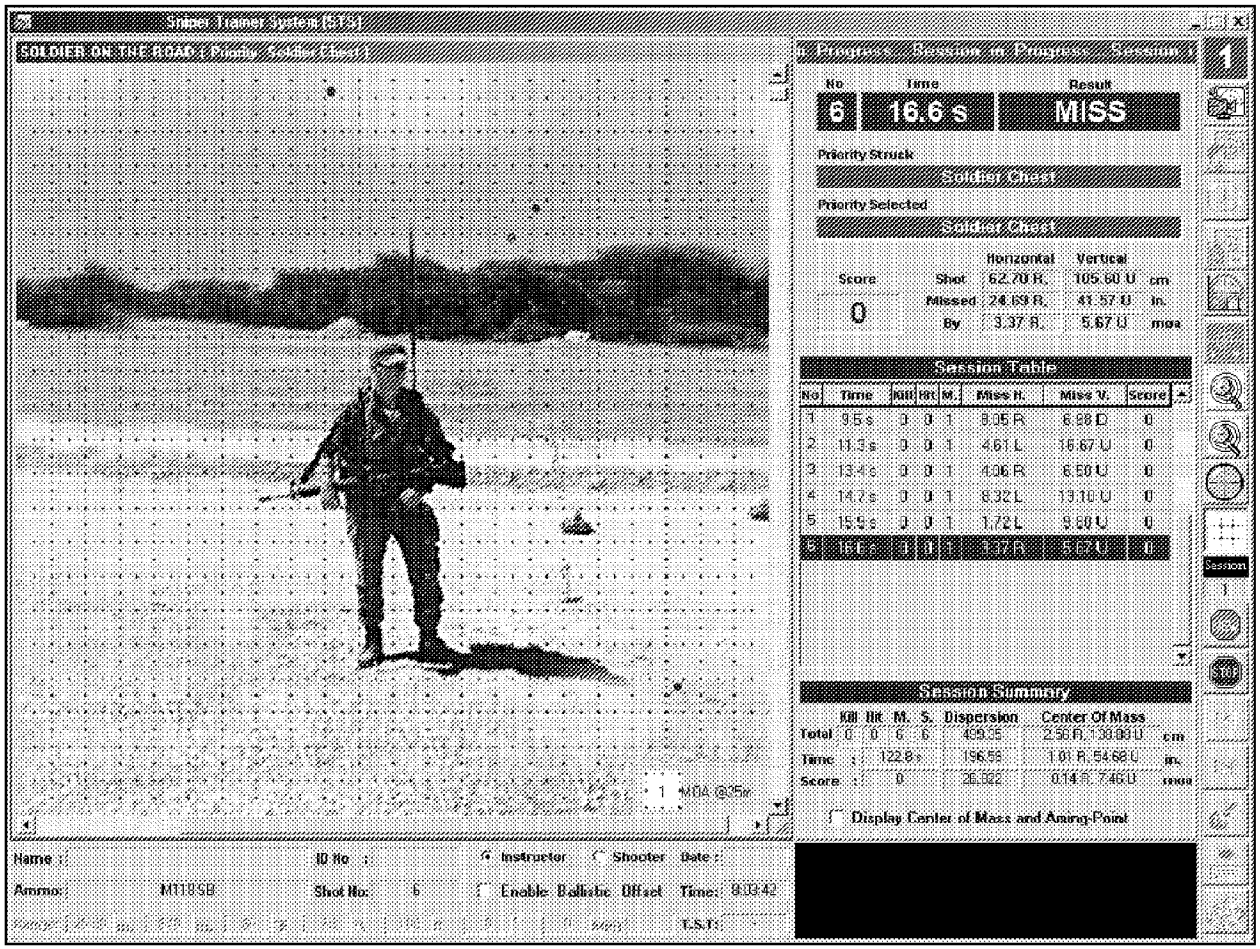
FIG. 13 is a schematic illustration of an exemplary graphical user screen with a minutes of angle overlay.

In addition, the present invention provides several advantages including: training with actual weapon and weapon sights; firearm simulation by a weapon mounted eye-safe or other training laser; computerized target feedback, including internal ballistics software module to adjust bullet point of impact (e.g., instructors may enter real-world variables that affect trajectory); weapon sight(s) must be adjusted using skill based standards (e.g., adjusting specified number of clicks on a MilDot scope for range, windage, etc.) to achieve target hit. Target presentations may be of various types to facilitate target identification, target priority and range estimation of various silhouettes and non-human objects; target presentations and backgrounds can be from user acquired imagery incorporated into the trainer to enhance realism and relevancy; each target presentation corresponds to the display on the computer screen in scale, color and wind references. The computer system display may also be overlaid with a minute of angle (MOA) grid to reference impacts (e.g., miss and hit) with sight corrections applied in one MOA and one-half MOA increments. The MOA are basically used to estimate distance. An MOA grid allows users to estimate and adjust points of aim using visual comparisons between MOA units and items in the target area in order to avoid reliance upon time consuming and complex calculations. The MOA grid is displayed as an overlay by the computer system to assist the user in enhancing various skills (e.g., determining distance, adjusting point of aim, etc.). An exemplary graphical user screen displayed by the above-described systems and illustrating an MOA overlay on a target display is illustrated in FIG. 13. Further, the systems may include a zoom feature that allows a user to zoom in or out with respect to the target and/or selected objects within a particular target image. The systems include proven components to enhance reliability, supportability and ease of use (e.g., components are compatible with other training systems, such as those disclosed in the above patent and patent applications). The system software includes a module common to the above training systems to simplify interface, database management and reporting and to ensure configuration management, while the trainer is self-calibrating, lightweight and low cube, operational during day or night, requires no special facilities or preparation, works directly with any caliber sniper-type or other rifles and may be adapted for similar functions with other devices (e.g., missile or other weapon systems, etc.).

It will be appreciated that the embodiments described above and illustrated in the drawings represent only a few of the many ways of implementing a firearm laser training system and method facilitating firearm training for extended range targets with feedback of firearm control.

The systems may include any quantity of any type of target placed in any desired locations. The computer system may be in communication with other training systems via any type of communications medium (e.g., direct line, telephone line/modem, network, etc.) to facilitate group training or competitions. The systems may be configured to simulate any types of training, qualification or competition scenarios. The printer may be implemented by any conventional or other type of printer.

The systems may include any quantity of computer systems, target controllers, instructor systems and/or spectator systems. These processing systems may be implemented by any conventional or other computer or processing system (e.g., PC, laptop, palm pilot, PDA, etc.). The components of the systems (e.g., computer system, USB extenders, hub, barcode reader, detection device, etc.) may include and communicate via any communications devices (e.g., cables, wireless, network, etc.) in any desired fashion, and may utilize any type of conventional or other interface scheme or protocol. The network may be implemented by any communications medium (e.g., LAN, WAN, Internet, Intranet, wired, wireless, etc.), while the devices may alternatively directly communicate with each other.

The firearm laser training systems may be utilized with any type of firearm or other device (e.g., hand-gun, rifle, shotgun, machine gun, missile or other weapon system, etc.), while the laser module may be fastened to the firearm at any suitable locations via any conventional or other fastening techniques (e.g., frictional engagement with the barrel, brackets attaching the device to the firearm, etc.). Further, the system may include a dummy firearm projecting a laser beam, or replaceable firearm components (e.g., a barrel) including a laser device disposed therein for firearm training. The replaceable components (e.g., barrel) may further enable the laser module to be operative with a firearm utilizing any type of blank cartridges.

The laser assembly may include the laser module and bracket or any other fastening device. The laser module may emit any type of laser beam, preferably within suitable safety tolerances. The laser module housing may be of any shape or size, and may be constructed of any suitable materials. The receptacles may be defined in the module housing at any suitable locations to engage the bracket. Alternatively, the housing and bracket may include any conventional or other fastening devices (e.g., integrally formed, threaded attachment, hook and fastener, frictional engagement, etc.) to attach the module to the bracket. In another exemplary embodiment, the laser module may be attached without a bracket (e.g., by frictional engagement with the inside surface of the barrel via a rod or a similar device that engages the inside surface of the barrel). The bracket base and cover members may be of any size or shape and may be constructed of any suitable materials. The laser module may be fastened to the base and/or cover members at any locations via any suitable fastening mechanisms. The openings within the base and cover members may be of any quantity, shape or size and may be defined at any suitable locations. The bolts may be implemented by any securing or fastening devices (e.g., clamps, screws, posts, etc.).

The optics package may include any suitable lens for projecting the beam. The laser beam may be enabled for any desired duration sufficient to enable the detection device to detect the beam. The laser module may be fastened to a firearm or other similar structure (e.g., a dummy, toy or simulated firearm) at any suitable locations (e.g., external or internal of a barrel) and be actuated by a trigger or any other device (e.g., power switch, firing pin, relay, etc.). Moreover, the laser module may be configured in the form of ammunition for insertion into a firearm firing or similar chamber and project a laser beam in response to trigger actuation. Alternatively, the laser module may be configured for direct insertion into the barrel without the need for the bracket. The laser module may include any type of sensor or detector (e.g., acoustic sensor, piezoelectric element, accelerometer, solid state sensors, strain gauge, etc.) to detect mechanical or acoustical waves or other conditions signifying trigger actuation. The laser module components may be arranged within the housing in any fashion, while the module power source may be implemented by any type of batteries. Alternatively, the module may include an adapter for receiving power from a common wall outlet jack or other power source. The laser beam may be visible or invisible (e.g., infrared), may be of any color and may be modulated in any fashion (e.g., at any desired frequency or unmodulated) or encoded to provide any desired information, while the transmitter may project the beam continuously or include a "constant on" mode.

The target may be implemented by any type of target having any desired configuration and indicia forming any desired target site. The target may be of any shape or size, and may be constructed of any suitable materials. The target may include any conventional or other fastening devices to attach to any supporting structure. Similarly, the supporting structure may include any conventional or other fastening devices to secure the target to that structure. Alternatively, any type of adhesive or magnetic material may be utilized to secure the target to the structure. The support structure may be implemented by any structure suitable to support or suspend the target. The target may include any quantity of sections or zones of any shape or size and associated with any desired values or information (e.g., hit/miss, vital area, etc.). The target may include any quantity of individual targets or target sites. The systems may utilize any type of coding scheme to associate values with target sections (e.g., table lookup, target location identifiers as keys into a database or other storage structure, etc.). Further, the sections may be identified by any type of codes, such as alphanumeric characters, numerals, etc., that indicate a score or zone. The score values may be set to any desired values. Zones may be identified in any manner (e.g., enemy, friendly, non-engageable, priority, etc.).

The display screen may be of any shape, size or type (e.g., LCD, plasma, monitor, etc.) and may be disposed at any desired location. The display screen may display any type of target scaled for any desired range or unscaled. The display screen may alternatively show movies or video illustrating a stationary or moving target, a target scenario or environmental or other conditions. The images and/or video may be stored locally on the computer system or target controller, or may be retrieved from a network or other processing system.

The target characteristics and images may be contained in any quantity of any types of files. The target images may be scaled in any desired fashion. The coordinate translations may be accomplished via any conventional or other techniques, and may be performed within the detection device. The translations for the various files (e.g., print, scoring, display, etc.) may be determined with respect to impact locations with or without the offsets applied, while the corresponding files may be configured accordingly. For example, the files may be generated to incorporate the offsets, thereby reducing processing during system operation (e.g., by enabling beam impact locations without offsets to be used). The target files may contain any information pertaining to the target (e.g., filenames, images, scaling information, indicia size, etc.). The target files may be produced by the computer system or other processing system and placed on the computer system for operation. Alternatively, the target files may reside on another processing system accessible to the computer system via any conventional or other communications medium (e.g., network, modem/telephone line, etc.).

The barcode reader may be of any type and configuration and may be connected or in communication with the computer system in any suitable manner. Alternatively, the computer system may utilize any suitable device or interface to receive information regarding the type of target being utilized in a particular training session. The target serial number may include any quantity of any alphanumeric character or other symbol. The range finder may be implemented by any conventional or other device that can measure distance (e.g., ultrasound device, radio device, etc.).

The detection device may be implemented by any conventional or other sensing device (e.g., camera, CCD, CMOS, matrix or array of light sensing elements, etc.) suitable for detecting the laser beam and/or capturing a target image. The filter may be implemented by any conventional or other filter having filtering properties for any particular frequency or range of frequencies. The detection device may employ any type of light sensing elements. The detection device may be of any shape or size, and may be constructed of any suitable materials. The detection device may be positioned at any suitable locations providing access to the target. The calibration may utilize any type of target and user interface to calibrate the systems. The calibration target may be an image or displayed by the display screen. The calibration target and user interface may include any quantity of alignment guides and/or lines to calibrate the system. Further, the user may adjust the detection device, target and/or interface in any manner to calibrate the system. The zeroing adjustment may be performed at any time prior, during or subsequent a session. The zeroing may utilize any quantity of shots and any type of calculation to determine an offset. The offset may be determined based on any characteristics of the shot grouping and relative to any desired target site. The offset may alternatively be adjusted or entered by a user.

The detection device may be coupled to any computer system port via any conventional or other cable. The detection device may be configured to detect any energy medium having any modulation, pulse or frequency. Similarly, the laser may be implemented by a transmitter emitting any suitable energy wave. The detection device may transmit any type of information to the computer system to indicate beam impact locations, while the computer system may process any type of information from the detection device to display and provide feedback information to the user.

It is to be understood that the software for the computer system, target controller, instructor system and spectator system maybe implemented in any desired computer language and could be developed by one of ordinary skill in the computer arts based on the functional descriptions contained in the specification and flow chart illustrated in the drawings. These processing systems may alternatively be implemented by hardware or other processing circuitry. The various functions of these systems maybe distributed in any manner among any quantity of processing systems, circuitry and hardware and/or software modules or units. The software and/or algorithms described above and illustrated in the flow chart may be modified in any manner that accomplishes the functions described herein. The database may be implemented by any conventional or other database or storage structure (e.g., file, data structure, etc.).

The graphical user screens and reports maybe arranged in any fashion and contain any type of information. The indicia indicating target impact locations and other information may be of any quantity, shape, size or color and may include any type of information. The indicia may be placed at any locations and be incorporated into or overlaid with the target images. The systems may produce any desired type of display or report having any desired information. The computer system may determine scores based on any desired criteria. The computer system may poll the detection device or the detection device may transmit images at any desired intervals for the tracing mode. The indicia for the tracing mode may be of any quantity, shape, size or color and may include any type of information. The tracing indicia may be placed at any locations and be incorporated into or overlaid with the target images.

The systems may utilize optical and/or electronic filters to reduce false detections. The laser and LIB may be coupled to each other and the computer system in any fashion or desired arrangement. For example, the laser and LIB may be coupled to a parallel port connector of the computer system and transfer signals therethrough. Alternatively, the laser may be coupled to the LIB which, in turn, is coupled to the computer system parallel port. The LIB may be housed within any system components or be external of those components. The LIB may include any conventional circuitry or components (e.g., regulator, comparator, pulse condition timer, buffer, etc.) arranged in any desired fashion to perform the functions described herein. The trace mode may track and display firearm movement for any desired time interval commencing prior to, during or after trigger actuation. Alternatively, the trace mode may be utilized without the electronic laser filter by the systems detecting a continuous laser beam for a predetermined time interval and processing captured images as described above. The trace mode may display the information in any desired manner (e.g., plot, chart, graph, etc.). The computer system may utilize any desired overlays to emulate any views through the scope or of the target (e.g., MOA, MilDot, etc.). The MilDot or other overlays may be manipulated on the image via any input devices (e.g., mouse, keyboard, firearm laser movement, voice recognition, etc.).

Ballistic information from the ballistic program maybe retrieved or intercepted in any desired fashion (e.g., intercept window writes, write program output to a readable file or data structure, direct interaction via dynamic data exchange (DEE), etc.). The targets utilized with the systems of the present invention may be produced utilizing any suitable procedure. The offsets may be determined prior to a session and stored by the system in any manner (e.g., tables, data structures, etc.), or particular offsets may be generated and applied during processing of images.

The systems may utilize any quantity of any types of devices (e.g., extenders, cables, etc.) to facilitate communication between the detection device, bar code reader and computer system. The carrying case may be of any shape or size and may be constructed of any suitable materials. The case may include any quantity of compartments of any shape or size to accommodate any system components. The system components may be arranged in the case in any desired fashion. The computer system may communicate with any quantity of training systems via any communications medium (e.g., network, cables, wireless, etc.) to facilitate group training. Further, the instructor and spectator systems may similarly be coupled to plural training systems via any communications medium (e.g., network, cables, wireless, etc.) to control and monitor group training. The systems may include and process any quantity of targets (e.g., plural images or display screens) via any quantity of detection devices in substantially the same manner described above for plural target sessions. The detection device may handle plural targets, where the computer system processes the captured images to determine target impact locations as described above.

The present invention is not limited to the applications disclosed herein, but may be utilized for any type of firearm training, qualification or competition. Further, the present invention may utilize offsets to simulate any types of conditions (e.g., wind, precipitation, elevation, humidity, type of projectile, etc.) for targets at any desired ranges.

From the foregoing description, it will be appreciated that the invention makes available a novel firearm laser training system and method facilitating firearm training for extended range targets with feedback of firearm control, wherein the system scans a simulated extended range target to determine laser beam impact locations and applies an offset to those locations to simulate various conditions (e.g., range, wind, etc.) affecting projectile trajectory and determine an impact location relative to the target resulting from those conditions.

Having described preferred embodiments of a new and improved firearm laser training system and method facilitating firearm training for extended range targets with feedback of firearm control, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A firearm laser training system enabling a user to project a laser beam from a laser transmitter assembly secured to a firearm toward an intended site on a target to simulate firearm operation, wherein said firearm includes a sight that is adjusted by a user in accordance with at least one condition, thereby displacing a firearm point of aim relative to said intended target site, said system comprising:

a target;

a sensing device to detect impact locations of said laser beam on said target resulting from said adjusted sight and displaced point of aim of said firearm and to produce impact information; and a processor to receive and process said impact information from said sensing device to display simulated target impact locations under said at least one condition, wherein said processor includes:

an impact module to determine coordinates of beam impact locations on said target from said impact information, wherein said determined beam impact locations are displaced relative to said intended target site in accordance with said adjusted sight and displaced point of aim of said firearm; and a projectile simulation module to compensate for said adjusted sight and displaced point of aim of said firearm by adjusting said determined coordinates of said beam impact locations in accordance with said at least one condition to determine simulated impact locations relative to said intended site on said target, wherein said at least one condition includes at least one environmental condition, and wherein said projectile simulation module includes:

an offset module to apply coordinate offsets to said determined coordinates of said beam impact locations to produce said simulated target impact locations, wherein said offsets represent projectile trajectory adjustments in accordance with particular conditions.

2. The system of claim 1, wherein said target is scaled to simulate a range of at least twenty-five meters.

3. The system of claim 2 further including a range measuring device employing energy signals to determine a location appropriately distanced from said target to simulate training at said range.

4. The system of claim 1, wherein said environmental condition includes at least one of: temperature, elevation, barometric pressure and humidity.

5. The system of claim 1, wherein said processor further includes an offset generation module to determine said trajectory adjustment offsets in accordance with said at least one condition.

6. The system of claim 1, wherein said processor further includes an entry module to enable entry of information measured for a firearm during actual firing, wherein said entered information corresponds to said offsets.

7. The system of claim 1, wherein said target includes a stationary target image.

8. The system of claim 1, wherein said target includes a display screen.

9. The system of claim 8, wherein said display screen displays at least one of a target image, a video including a moving target, a video including a target scenario and a video indicating said conditions.

10. The system of claim 8 further including a screen controller to control said display screen to display a target for training, wherein said screen controller is in communication with said processor.

11. The system of claim 10, wherein said screen controller and said processor communicate via a network.

12. The system of claim 10 further including an administrator system in communication with at least one of said screen controller and said processor to control said training and provide information relating to user performance to a training administrator.

13. The system of claim 10 further including an observer system in communication with at least one of said screen controller and said processor to provide information relating to user performance to a training observer.

14. The system of claim 1, wherein said target includes an actuable target assembly to adjust a target location between a plurality of positions.

15. The system of claim 1, wherein said processor further includes a communication module to communicate with at least one other firearm training system via a network to conduct a joint training session with that other system.

16. The system of claim 1, wherein said processor further includes an evaluation module to process said impact information to evaluate user performance and to display information relating to said evaluation and an image of said target with indicia indicating said simulated target impact locations.

17. The system of claim 16, wherein said processor further includes an overlay module to display a MilDot overlay on said target image.

18. The system of claim 17, wherein said processor further includes a trace module to track movement of said firearm based on said impact information, wherein said trace module adjusts said MilDot overlay on said target image in accordance with said firearm movement.

19. The system of claim 16, wherein said processor further includes an overlay module to display a minutes of angle overlay on said target image.

20. The system of claim 16, wherein said target includes at least one zone each associated with performance information and said evaluation module includes a performance module to evaluate user performance based on said performance information of zones associated with said simulated target impact locations.

21. The system of claim 20, wherein said performance module includes a scoring module to access a target file associated with said target including score values associated with each of said zones and to determine an aggregate score for a user by accumulating score values of zones associated with said simulated target impact locations.

22. The system of claim 1, wherein said processor further includes a calibration module to correlate a target space associated with said target with a target space associated with said sensing device.

23. The system of claim 22, wherein said calibration module includes an overlay module to display an overlay on an image of a calibration target to facilitate alignment of said target spaces of said target and said sensing device.

24. The system of claim 1, wherein said processor further includes a trace module to track and display movement of said firearm based on said impact information.

25. The system of claim 24, wherein said trace module graphically displays said firearm movement in the form of a plot of firearm fluctuation.

26. The system of claim 1 further including a case to secure and transport at least said target and said sensing device.

27. The system of claim 1 further including a bar code reader to retrieve a target identifier and identify said target to said processor.

28. The system of claim 1, wherein said processor further includes a report module to generate a report for printing indicating user performance and including an image of said target with indicia indicating said simulated target impact locations.

29. The system of claim 1, wherein said processor further includes a zeroing adjustment module to examine at least two beam impacts and to determine a zeroing offset between a characteristic of said at least two beam impacts and a reference target site, wherein said zeroing offset is utilized to determine said simulated target impact locations and to zero said laser transmitter assembly.

30. The system of claim 1, wherein said processor further includes an impact verification module to verify beam impacts within said impact information, wherein said impact verification module verifies that a beam impact within said impact information is within a predetermined range from prior verified impact locations.

31. The system of claim 1, further including an actuation detection unit coupled to said laser transmitter assembly and said processor to detect actuation of said firearm and transmit an actuation signal to said processor in response to said detection, wherein said impact module processes said impact information in response to said actuation signal to reduce false detections.

32. The system of claim 31, wherein said processor further includes a trace module to track and display movement of said firearm based on said impact information, wherein said trace module tracks said firearm movement for a predetermined time interval relative to receipt of said actuation signal.

33. The system of claim 32, wherein said trace module graphically displays said firearm movement in the form of a plot of firearm fluctuation for said predetermined time interval.

34. The system of claim 31, wherein said actuation detection unit includes:

a regulator to supply power to said laser transmitter assembly;

a comparator to compare a ground signal from said laser transmitter assembly with a reference potential from said regulator, wherein said laser transmitter assembly produces a deviation between these signals in response to detecting firearm actuation and said comparator produces an output signal indicating the presence of said deviation;

a pulse condition timer to adapt said comparator output for compatibility with said processor to produce said actuation signal; and a buffer to store said actuation signal for transmission to said processor.

35. The system of claim 1, wherein said sensing device scans said target to produce said impact information in the form of scanned images.

36. A firearm laser training system enabling a user to project a laser beam from a laser transmitter assembly secured to a firearm toward an intended site on a target to simulate firearm operation, wherein said firearm includes a sight that is adjusted by a user in accordance with at least one condition, thereby displacing a firearm point of aim relative to said intended target site, said system comprising:

a target;

a sensing device to detect impact locations of said laser beam on said target resulting from said adjusted sight and displaced point of aim of said firearm and to produce impact information; and a processor to receive and process said impact information from said sensing device to display simulated target impact locations under said at least one condition, wherein said processor includes:

an impact module to determine coordinates of beam impact locations on said target from said impact information, wherein said determined beam impact locations are displaced relative to said intended target site in accordance with said adjusted sight and displaced point of aim of said firearm, and to determine simulated impact locations relative to said intended target site by adjusting said determined coordinates of said beam impact locations in accordance with said at least one condition to compensate for said adjusted sight and displaced point of aim of said firearm, wherein said at least one condition includes at least one environmental condition, and wherein said impact module includes:

an offset module to apply coordinate offsets to said determined coordinates of said beam impact locations to produce said simulated target impact locations, wherein said offsets represent projectile trajectory adjustments in accordance with particular conditions; and an actuation detection unit coupled to said laser transmitter assembly and said processor to detect actuation of said firearm and transmit an actuation signal to said processor in response to said detection, wherein said impact module processes said impact information in response to said actuation signal to correlate determined impact locations with firearm actuation to reduce false detections.

37. The system of claim 36, wherein said actuation detection unit includes:

a regulator to supply power to said laser transmitter assembly;

a comparator to compare a ground signal from said laser transmitter assembly with a reference potential from said regulator, wherein said laser transmitter assembly produces a deviation between these signals in response to detecting firearm actuation and said comparator produces an output signal indicating the presence of said deviation;

a pulse condition timer to adapt said comparator output signal for compatibility with said processor to produce said actuation signal; and a buffer to store said actuation signal for transmission to said processor.

38. A firearm laser training system enabling a user to project a laser beam from a laser transmitter assembly secured to a firearm toward an intended site on an extended range target to simulate firearm operation within a confined area having dimensions less than the extended range, wherein said firearm includes a sight that is adjusted by a user in accordance with said extended range, thereby displacing a firearm point of aim relative to said intended target site, said system comprising:

a target scaled to simulate said extended range of at least twenty-five meters;

a sensing device to detect impact locations of said laser beam on said target resulting from said adjusted sight and displaced point of aim of said firearm and to produce impact information; and a processor to receive and process said impact information from said sensing device to display simulated target impact locations at said extended range, wherein said processor includes:

an impact module to determine coordinates of beam impact locations on said target from said impact information, wherein said determined beam impact locations are displaced relative to said intended target site in accordance with said adjusted sight and displaced point of aim of said firearm; and a projectile simulation module to adjust said determined coordinates of said beam impact locations in accordance with said extended range to compensate for said adjusted sight and displaced point of aim of said firearm and determine simulated impact locations at said extended range and relative to said intended site on said target, wherein said projectile simulation module includes:

an offset module to apply coordinate offsets to said determined coordinates of said beam impact locations to produce said simulated target impact locations, wherein said offsets represent projectile trajectory adjustments in accordance with particular conditions including said extended range and at least one of: temperature, elevation, barometric pressure and humidity.

39. The system of claim 38, wherein said processor further includes an offset generation module to determine said trajectory adjustment offsets in accordance with said conditions.

40. The system of claim 38, wherein said processor further includes an entry module to enable entry of information measured for a firearm during actual firing, wherein said entered information corresponds to said offsets.

41. The system of claim 38, wherein said target includes a display screen that displays at least one of a target image, a video including a moving target, a video including a target scenario and a video indicating at least one of said conditions.

42. The system of claim 38, wherein said sensing device scans said target to produce said impact information in the form of scanned images.

43. In a firearm simulation system enabling a user to project a laser beam from a laser transmitter assembly secured to a firearm toward an intended site on a target and including a sensing device and a processor, wherein said firearm includes a sight that is adjusted by a user in accordance with at least one condition, thereby displacing a firearm point of aim relative to said intended target site, a method of simulating firearm operation comprising:

(a) detecting impact locations of said laser beam on said target resulting from said adjusted sight and displaced point of aim of said firearm via said sensing device and producing impact information for transmission to said processor;

(b) determining coordinates of beam impact locations on said target from said impact information, wherein said determined beam impact locations are displaced relative to said intended target site in accordance with said adjusted sight and displaced point of aim of said firearm; and (c) compensating for said adjusted sight and displaced point of aim of said firearm by adjusting said determined coordinates of said beam impact locations in accordance with said at least one condition to determine simulated impact locations relative to said intended site on said target, wherein said at least one condition includes at least one environmental condition, and wherein step (c) further includes:

(c.1) applying coordinate offsets to said determined coordinates of beam impact locations to produce said simulated target impact locations, wherein said offsets represent projectile trajectory adjustments in accordance with particular conditions.

44. The method of claim 43, wherein said target is scaled to simulate a range of at least twenty-five meters.

45. The method of claim 43, wherein said environmental condition includes at least one of: temperature, elevation, barometric pressure and humidity.

46. The method of claim 43, wherein step (c.1) further includes:

(c.1.1) determining said trajectory adjustment offsets in accordance with said at least one condition.

47. The method of claim 43 wherein step (c.1) further includes:

(c.1.1) facilitating entry of information measured for a firearm during actual firing, wherein said entered information corresponds to said offsets.

48. The method of claim 43, wherein said target includes a stationary target image.

49. The method of claim 43, wherein said target includes a display screen, and step (a) further includes:

(a.1) displaying at least one of a target image, a video including a moving target, a video including a target scenario and a video indicating said conditions on said display screen.

50. The method of claim 43, wherein said firearm simulation system further includes an administrator system, and step (a) further includes:

(a.1) facilitating control of said simulation by a training administrator via said administrator system;

and step (c) further includes:

(c.2) providing information relating to user performance to said training administrator.

51. The method of claim 43, wherein said firearm simulation system further includes an observer system, and step (c) further includes:

(c.2) providing information relating to user performance to a training observer via said observer system.

52. The method of claim 43, wherein step (a) further includes:

(a.1) facilitating communication with at least one other firearm simulation system via a network to conduct a joint training session with that other system.

53. The method of claim 43, wherein step (c) further includes:

(c.2) evaluating user performance based on said impact information and displaying information relating to said evaluation and an image of said target with indicia indicating said simulated target impact locations.

54. The method of claim 53, wherein step (c.2) further includes:

(c.2.1) displaying a MilDot overlay on said target image.

55. The method of claim 54, wherein step (c.2.1) further includes:

(c.2.1.1) tracking movement of said firearm based on said impact information and adjusting said MilDot overlay on said target image in accordance with said firearm movement.

56. The method of claim 53, wherein step (c.2) further includes:

(c.2.1) displaying a minutes of angle overlay on said target image.

57. The method of claim 53, wherein said target includes at least one zone each associated with performance information, and step (c.2) further includes:

(c.2.1) evaluating user performance based on said performance information of zones associated with said simulated target impact locations.

58. The method of claim 57, wherein step (c.2.1) further includes:

(c.2.1.1) accessing a target file associated with said target including score values associated with each of said zones to determine an aggregate score for a user by accumulating score values of zones associated with said simulated target impact locations.

59. The method of claim 43, wherein step (a) further includes:

(a.1) correlating a target space associated with said target with a target space associated with said sensing device.

60. The method of claim 59, wherein step (a.1) further includes:

(a.1.1) displaying an overlay on an image of a calibration target to facilitate alignment of said target spaces of said target and said sensing device.

61. The method of claim 43, wherein step (c) further includes:

(c.2) tracking and displaying movement of said firearm based on said impact information.

62. The method of claim 61, wherein step (c.2) further includes:

(c.2.1) graphically displaying said firearm movement in the form of a plot of firearm fluctuation.

63. The method of claim 43, wherein said firearm simulation system further includes a bar code reader, and step (a) further includes:

(a.1) retrieving a target identifier via said bar code reader and identifying said target to said processor.

64. The method of claim 43, wherein step (c) further includes:

(c.2) generating a report for printing indicating user performance and including an image of said target with indicia indicating said simulated target impact locations.

65. The method of claim 43, wherein step (c) further includes:

(c.2) examining at least two beam impacts to determine a zeroing offset between a characteristic of said at least two beam impacts and a reference target site, wherein said zeroing offset is utilized to determine said simulated target impact locations and to zero said laser transmitter assembly.

66. The method of claim 43, wherein step (b) further includes:

(b.1) verifying beam impacts within said impact information by verifying that a beam impact within said impact information is within a predetermined range from prior verified impact locations.

67. The method of claim 43, wherein said firearm simulation system further includes an actuation detection unit coupled to said laser transmitter assembly and said processor to detect actuation of said firearm and transmit an actuation signal to said processor in response to said detection, and step (b) further includes:

(b.1) processing said impact information in response to said actuation signal to reduce false detections.

68. The method of claim 67, wherein step (c) further includes:

(c.2) tracking and displaying movement of said firearm based on said impact information, wherein said firearm movement is tracked for a predetermined time interval relative to receipt of said actuation signal.

69. The method of claim 68, wherein step (c.2) further includes:

(c.2.1) graphically displaying said firearm movement in the form of a plot of firearm fluctuation for said predetermined time interval.

70. The method of claim 43, wherein step (a) further includes:

(a.1) scanning said target via said sensing device to produce said impact information in the form of scanned images.

71. In a firearm simulation system enabling a user to project a laser beam from a laser transmitter assembly secured to a firearm toward an intended site on a target and including a sensing device, a processor and an actuation detection unit coupled to said laser transmitter assembly and said processor to detect actuation of said firearm, wherein said firearm includes a sight that is adjusted by a user in accordance with at least one condition, thereby displacing a firearm point of aim relative to said intended target site, a method of simulating fireman operation comprising:

(a) detecting impact locations of said laser beam on said target resulting from said adjusted sight and displaced point of aim of said firearm via said sensing device and producing impact information for transmission to said processor;

(b) detecting actuation of said firearm via said actuation detection unit and transmitting an actuation signal to said processor in response to said detection; and (c) determining coordinates of beam impact locations on said target from said impact information, wherein said determined beam impact locations are displaced relative to said intended target site in accordance with said adjusted sight and displaced point of aim of said firearm, and determining simulated impact locations relative to said intended target site by adjusting said determined coordinates of beam impact locations in accordance with said at least one condition to compensate for said adjusted sight and displaced point of aim of said firearm, wherein step (c) further includes:

(c.1) applying coordinate offsets to said determined coordinates of beam impact locations to produce said simulated target impact locations, wherein said offsets represent projectile trajectory adjustments in accordance with particular conditions;

wherein said at least one condition includes at least one environmental condition, and wherein said impact information is processed in response to said actuation signal to correlate determined beam impact locations with firearm actuation to reduce false detections.

72. In a firearm simulation system enabling a user to project a laser beam from a laser transmitter assembly secured to a firearm toward an intended site on an extended range target and including a sensing device and a processor, wherein said firearm includes a sight that is adjusted by a user in accordance with said extended range, thereby displacing a firearm point of aim relative to said intended target site, a method of simulating firearm operation within a confined area having dimensions less than the extended range comprising:

(a) presenting a target scaled to simulate said extended range of at least twenty-five meters;

(b) detecting impact locations of said laser beam on said target resulting from said adjusted sight and displaced point of aim of said firearm via said sensing device and producing impact information for transmission to said processor;

(c) determining coordinates of beam impact locations on said target from said impact information, wherein said determined beam impact locations are displaced relative to said intended target site in accordance with said adjusted sight and displaced point of aim of said firearm; and (d) adjusting said determined coordinates of said beam impact locations in accordance with said extended range to compensate for said adjusted sight and displaced point of aim of said firearm and determine simulated impact locations at said extended range and relative to said intended site on said target, wherein step (d) further includes:

(d.1) applying coordinate offsets to said determined coordinates of said beam impact locations to produce said simulated target impact locations, wherein said offsets represent projectile trajectory adjustments in accordance with particular conditions including said extended range and at least one of: temperature, elevation, barometric pressure and humidity.

73. The method of claim 72, wherein step (d.1) further includes:

(d.1.1) determining said trajectory adjustment offsets in accordance with said conditions.

74. The method of claim 72, wherein step (d.1) further includes:

(d.1.1) facilitating entry of information measured for a firearm during actual firing, wherein said entered information corresponds to said offsets.

75. The method of claim 72, wherein said target includes a display screen and step (a) further includes:

(a.1) displaying at least one of a target image, a video including a moving target, a video including a target scenario and a video indicating at least one of said conditions on said display screen.

76. The method of claim 72, wherein step (b) further includes:

(b.1) scanning said target via said sensing device to produce said impact information in the form of scanned images.

77. The system of claim 1, wherein said firearm includes a sniper weapon.

78. The system of claim 36, wherein said firearm includes a sniper weapon.

79. The system of claim 38, wherein said firearm includes a sniper weapon.

80. The method of claim 43, wherein said firearm includes a sniper weapon.

81. The method of claim 71, wherein said firearm includes a sniper weapon.

82. The method of claim 72, wherein said firearm includes a sniper weapon.

* * * * *